US005404126A

United States Patent [19]

Kasai et al.

[11] Patent Number: 5,404,126

[45] Date of Patent: Apr. 4, 1995

[54] FUSE RESISTOR, AND DISCHARGING-TYPE SURGE ABSORBING DEVICE WITH SECURITY MECHANISM

[75] Inventors: Yoshito Kasai, Kumagaya; Yoshiro Suzuki, Hanyu; Akihiko Ikazaki, Tokyo, all of Japan

[73] Assignee: Okaya Electric Industries Co., Ltd., Tokyo, Japan

[21] Appl. No.: 71,465

[22] Filed: Jun. 1, 1993

[30] Foreign Application Priority Data

Sep. 15, 1992 [JP] Japan ..... 4-271169
Oct. 22, 1992 [JP] Japan ..... 4-308182

[51] Int. Cl.[6] ..... H01C 1/012; H01C 7/10

[52] U.S. Cl. ..... 338/21; 338/22 R; 338/24; 338/195; 338/295; 338/306; 338/308; 338/314; 361/104

[58] Field of Search ..... 338/21, 195, 295, 308, 338/309, 314, 306, 24, 22 R; 361/103, 104, 112

[56] References Cited

U.S. PATENT DOCUMENTS

| | | | |
|---|---|---|---|
| 3,337,832 | 8/1967 | Hukee | 338/295 X |
| 3,978,443 | 8/1976 | Dennis et al. | 338/309 |
| 4,961,065 | 10/1990 | Taylor | 338/308 |
| 5,084,693 | 1/1992 | Taylor et al. | 338/306 |

*Primary Examiner*—Marvin M. Lateef
*Attorney, Agent, or Firm*—Harold L. Burstyn; Thomas R. Morrison

[57] ABSTRACT

A fuse resistor protects a circuit from a surge, an overcurrent from an unexpected connection, or the like. When a continuous overvoltage higher than a predetermined value is applied to the circuit, the heat from a heat-generating resistant film fractures an insulating substrate of the fuse resistor to open the circuit. Changing the minimum current to which the fuse resistor responds, by modifying a cutout or notch on the substrate, makes it possible to use the fuse resistor anywhere in the circuit. A discharging-type surge absorbing element with a security mechanism that includes the fuse resistor can thus provide protection against a surge or a continuous overcurrent that is more than the rated value of the fuse resistor.

11 Claims, 30 Drawing Sheets

FUSE RESISTOR, AND DISCHARGING-TYPE SURGE ABSORBING DEVICE WITH SECURITY MECHANISM

BACKGROUND OF THE INVENTION

1. Field of the Invention

This invention relates to a fuse resistor in which the heat of resistant film on an insulated substrate by overcurrent causes the substrate to break, so as to open a circuit, and to a discharging-type surge absorbing device with security mechanism comprising the fuse resistor and a discharging-type surge absorbing element.

2. Description of the Prior Art

Referring to FIG. 43, in a fuse resistor 150 a ruthenium paste and the like are spread as a heat generating resistant film 152 on the surface of an insulating substrate 151 made from ceramics such as alumina, forsterite, and like. An electrode pattern 153 formed at the both sides of resistant film 152 is connected to terminals 154. There is a triangle-shaped cutting 155 at the lower side of insulating substrate 151. (The term "cutting", as used in this application, is a literal translation of the Japanese original from which priority is claimed. A better term is "cutout" or "notch".)

Referring also to FIG. 44, terminals 154 are in a contact with an electronic circuit outside. For example, fuse resistor 150 is connected in series to discharging-type surge absorbing element 157 made from such as a gas arrester and the like between two lines A, A' constructed as a communication or power supply line to electronic circuit 156. When a big surge such as an inductive surge occurs at the lines, surge absorbing element 157 operates to absorb the surge. Also, when the lines are subjected to overvoltage that is more than a rated voltage of surge absorbing element 157 from an unexpected connection, the overcurrent causes heat generating resistant film 152 to heat, so that insulating substrate 15 1 is broken down along a line $\alpha$ (dash-line) from a top 158 of the cutting 155. Thus heat generating resistant film 152 is cut to open the circuit. The opening prevents surge absorbing element 157 from melting or igniting.

In another prior art example shown in FIG. 45, a discharging-type surge absorbing element with security mechanism 160 comprises an insulating substrate 161, a pair of heat generating resistant films 162 spread on a surface 161*a* of insulating substrate 161, a tiny discharging space 163 between resistant films 162, a pair of discharging electrodes 164 connected to resistant films 162 on a surface 16 1*a* of insulating substrate, a discharging space 165 between discharging electrode films 164, and a cover member 166 to cover surface 161*a* of insulating substrate 161, forming a space full of a discharged gas with surface 161 *a*.

This surge absorbing element 160 is connected to an electronic circuit through terminal film 167 connected with discharging electrode film 164. When a surge with more than a rated voltage of element 160 gets into the circuit, the potential difference between resistant films 162 generates a surface discharge at tiny space 163, thus producing a glow discharge by a priming effect. The increase of the surge current causes the glow discharge to be transformed into an arc discharge, so that the surge may be absorbed. Also, when the overvoltage continues to be applied to the circuit by an unexpected connection or the like, the overcurrent causes heat generating resistant film 162 to heat, and the substrate is broken down. As a result, air gets into the space full of the discharging gas. The arc discharge is disappeared at discharging space 165, opening the circuit.

In general, it is necessary to change a minimum shut-off current when breaking down insulating substrate 151 on fuse resistor 150, depending on the condition of the circuit. Let minimum shut-off current be I and resistance R, then heat amount W of resistant film 152 is expressed as follows:

$$W = I^2 * R$$

Then, when heat amount W is fixed, minimum shut-off current I depends on resistance R. A smaller current should be used with a larger resistance. However, if the resistance becomes too big when use resistor 150 is connected in series on either of two lines A, A', the transmission loss increases. Moreover, if connected between lines A, A', an outer electronics device receives a high voltage. There is a drawback that it is hard to adjust the minimum shut-off current directly by the resistance of resistant films 152.

To protect a circuit from overcurrent, it is necessary to break down insulating substrate 151 completely in a short time when the surge happens. There is another drawback in the prior art that the substrate may not be broken down completely, permitting an overcurrent destroy the electronics device or the surge absorbing element 157 to ignite itself.

Also, in discharging-type surge absorbing element 160, the same problem occurs. Insulating substrate 161 is not broken down enough. A necessary circuit is damaged by continuous overcurrent.

As a further drawback, since fuse resistor 150 can not change the minimum shut-off current, there are needed plenty of fuse resistors if each minimum shut-off current has to be changed at different positions.

OBJECTS AND SUMMARY OF THE INVENTION

It is an object of the present invention to provide a fuse resistor and a discharging-type surge absorbing element with a security mechanism which overcomes the drawbacks of the prior art.

To achieve the above object, the fuse resistor of the present invention comprises: an insulating substrate; a heat generating resistant film; the insulating substrate having at least one cutting; the cutting having a top angle which is adjustable; the heat generating resistant film formed on the insulating substrate; the heat generating resistant film connected to a circuit outside; the heat generating resistant film heating when an overcurrent more than a rated value is applied to the circuit; the insulating substrate broken by heat of the heat generating resistant film when the overcurrent exceeds a minimum shut-off current; and the minimum shut-off current being adjustable according to the cutting's condition.

The above cutting's condition can be adjusted by changing the number of cuttings, and the radius of curvature of the top of cuttings.

Furthermore, the discharging-type surge absorbing element with security mechanism of the present invention comprises: an insulating substrate; a pair of heat generating resistant films; a pair of discharging electrode films; a cover; the pair of heat generating resistant films formed on the insulating substrate; the pair of heat generating resistant films having a tiny discharging space therebetween; the pair of discharging electrode films formed on the insulating substrate; the pair of discharging electrode films connected to the heat generating resistant film; the pair of discharging electrode films having a discharging space therebetween; the cover covering the insulating substrate to produce a space for discharging filled with discharged gas; the pair of heat generating resistant films heating when an overcurrent more than a rated value the is applied to circuit; the insulating substrate broken down by heat of the heat generating resistant films; and the pair of heat generating resistant films having an appropriate resistance-temperature coefficient so as to break down the insulating substrate.

An initial resistance of the heat generating resistant film is set so as to break down the substrate. There are two foot portions at both sides of the insulating substrate.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
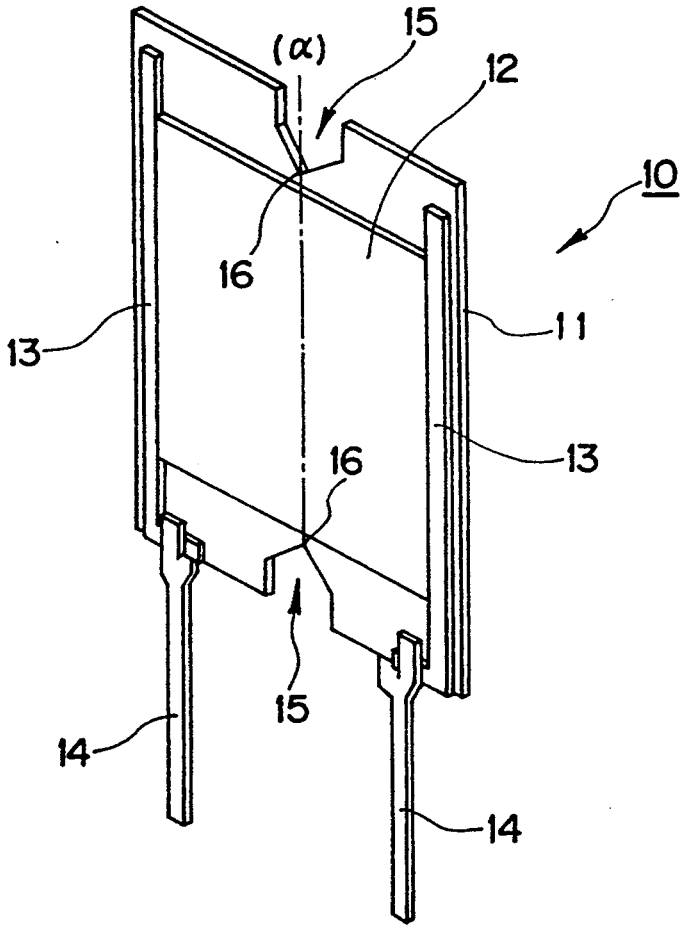
FIG. 1 is a perspective view showing a first fuse resistor according to this invention.
Figure 2:
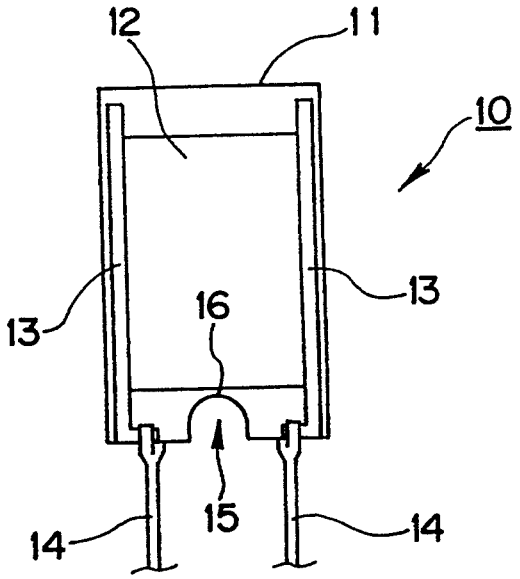
FIG. 2 is a front view showing a first cutting condition of the first fuse resistor.
Figure 3:
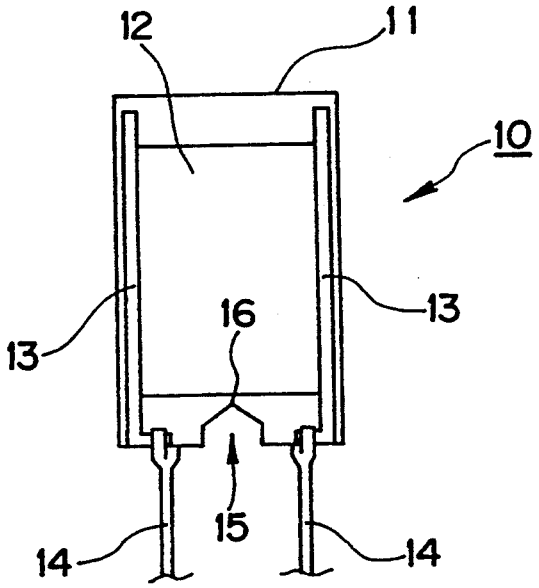
FIG. 3 is a front view showing a second cutting condition of the first fuse resistor.
Figure 4:
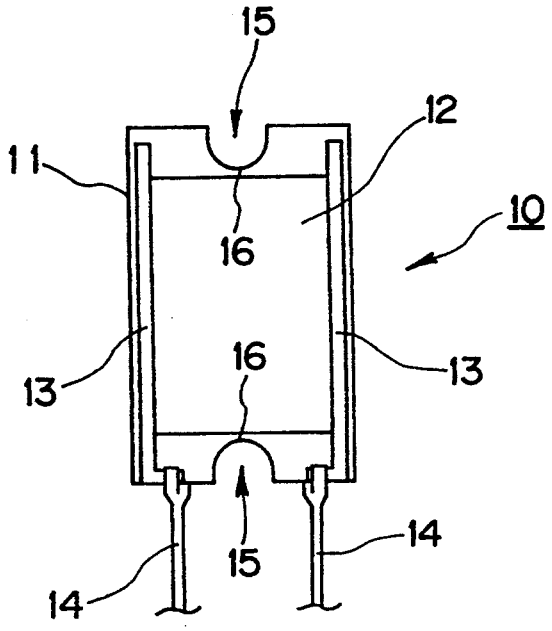
FIG. 4 is a front view showing a third cutting condition of the first fuse resistor.
Figure 5:
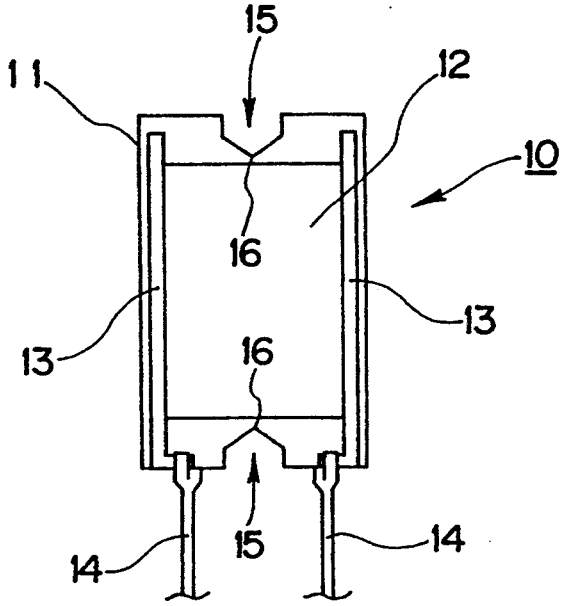
FIG. 5 is a front view showing a fourth cutting condition of the first fuse resistor.

Referring first to FIG. 1, a first fuse resistor 10 comprises an insulating substrate 11, a heat generating resistant film 12, electrode patterns 13 and terminals 14. Insulating substrate 11 is produced from ceramics such as alumina, forsterite, steatite and the like. Heat generating resistant film 12 is produced from such as ruthenium paste and the like. Electrode patterns 13 produced from such as silver-palladium paste and the like are arranged at both sides of resistant film 12. Terminals 14 are connected to the lower part of electrode patterns 13, 13. There are triangle-shaped cuttings 15 in the center top and bottom of insulating substrate 11. A crossover glass is spread at the surfaces of heat generating resistant film 12 and electrode pattern 13 (not shown in the drawings.)

A high temperature region is distributed on a dashed line $\alpha$ of resistant film 12, when overcurrent occurs. Cuttings 15 may be formed such that each top 16 is located on the line.

A minimum shut-off current value can be adjusted according to the number of cuttings 15 or the sharpness of the top of cuttings 15. For example, the values of fuse resistors 10 descend in sequence from FIGS. 2 to 5 if each fuse resistor 10 is the same except for the cutout part.

The above result means that the sharper the top 16 is, the more easily the substrate destroys, and also that the more cuttings on the substrate, the more easily the substrate is ruptured if the cutting has the same size and shape.

Figure 7:
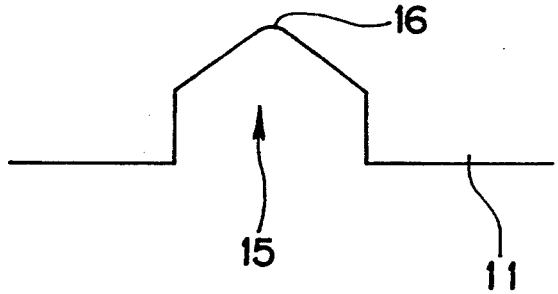
FIG. 7 is a partially enlarged view showing a second cutting pattern of the first fuse resistor.
Figure 8:
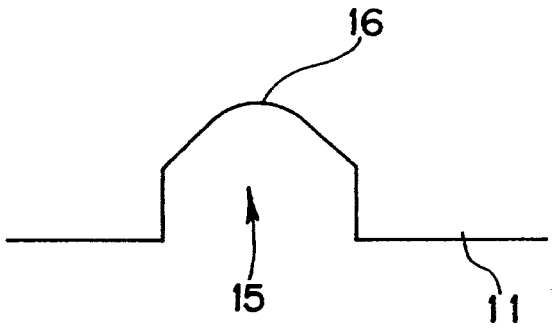
FIG. 8 is a partially enlarged view showing a third cutting pattern of the first fuse resistor.
Figure 9:
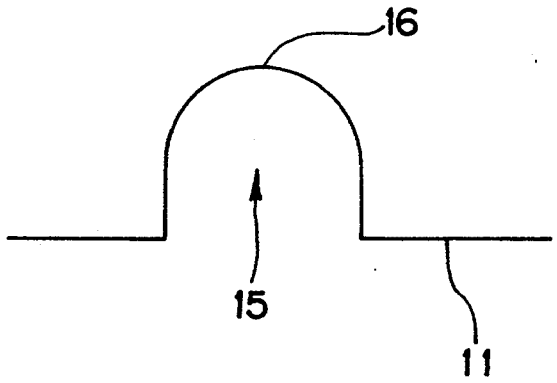
FIG. 9 is a partially enlarged view showing a fourth cutting pattern of the first fuse resistor.

There are shown some examples having a different sharpness in FIGS. 7 to 9. Sharpness depends upon the radius of curvature of the cutting. When insulating substrate 11 is cut by a laser, the radius of curvature can be adjusted such as 0.3R, 0.6R, and 0.9R in FIGS. 7 to 9, respectively.

It is also possible to adjust the minimum shut-off current by changing the angle of the top of cutting 15.

Accordingly, the minimum shut-off current of fuse resistor 10 can be set by changing the sharpness of cutting 15 and/or by changing the number of cutting 15, even if the resistance of heat generating resistant film 12 is not changed.

Figure 6:
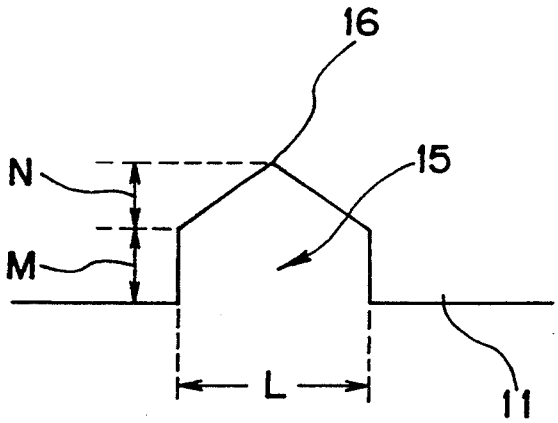
FIG. 6 is a partially enlarged view showing a first cutting pattern of the first fuse resistor.

In case of FIG. 6, the height, the width, and the thickness of insulating substrate 11 are defined as 15 to 16 mm, 9.6 mm, and 0.635 mm, respectively. Heat generating resistant film 12 has the resistance, the height, and the width of 47 Ω, 11 to 13 mm, and 7 mm, respectively. In cutting 15, the width of bottom L, the height M, N are defined as 2.6 mm, 1.0 mm, and 0.9 mm, respectively. Some results are given in the following Table 1 (including the case of no cutting 15 as a reference.)

According to the Table 1, the minimum shut-off current changes depending upon the cutting. It is possible to obtain the exact relationship between the setting condition and the minimum shut-off current by repeating the experiment.

TABLE 1

| CUTTING POSITION | RADIUS OF CURVATURE | MINIMUM SHUT-OFF CURRENT (A) |
|---|---|---|
| (1) NONE | NONE | 0.56 |
| (2) ONLY BOTTOM | 0.9R | 0.52 |
| (3) ONLY BOTTOM | 0.3R | 0.46 |
| (4) TOP AND BOTTOM | 0.6R | 0.42 |
| (5) TOP AND BOTTOM | 0.3R | 0.41 |

Figure 10:
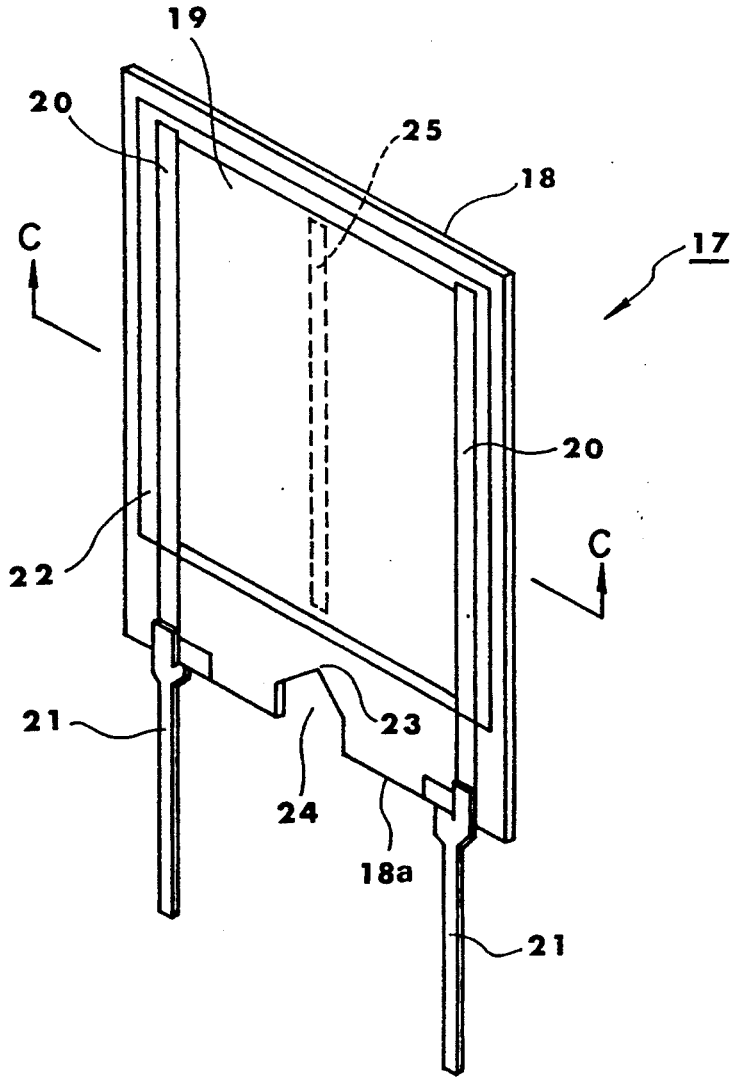
FIG. 10 is a perspective view showing a second fuse resistor according to this invention.

Referring to FIG. 10, a second fuse resistor 17 comprises an insulating substrate 18, a heat generating resistant film 19, electrode patterns 20 and terminals 21. Electrode patterns 20 are arranged at both sides of heat generating resistant film 12. Terminals 21 are connected to the lower part of electrode patterns 20. A crossover glass is spread at both surfaces of heat generating resistant film 19 and electrode pattern 20 (not shown in the drawings.)

Figure 11:
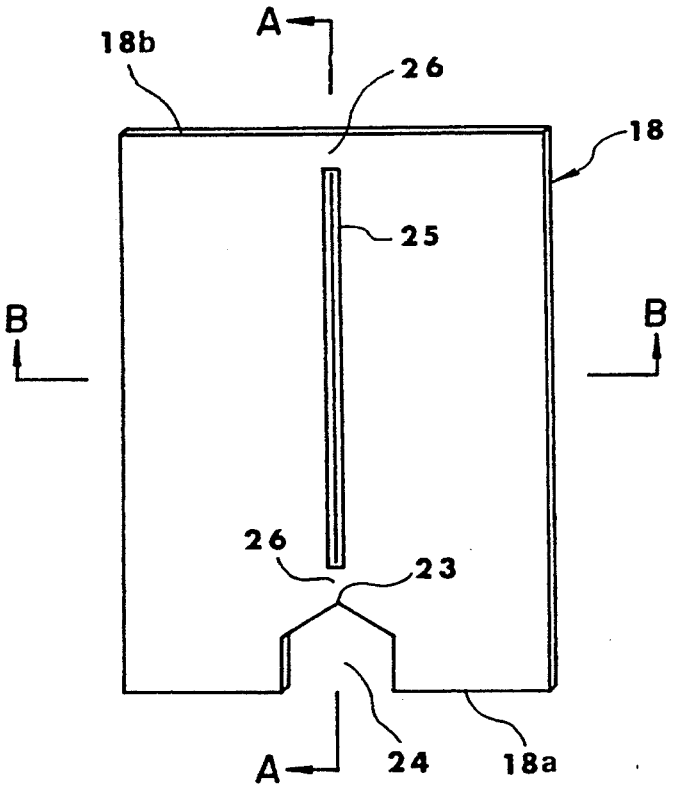
FIG. 11 is a perspective view showing an insulating substrate of the second fuse resistor.
Figure 12:
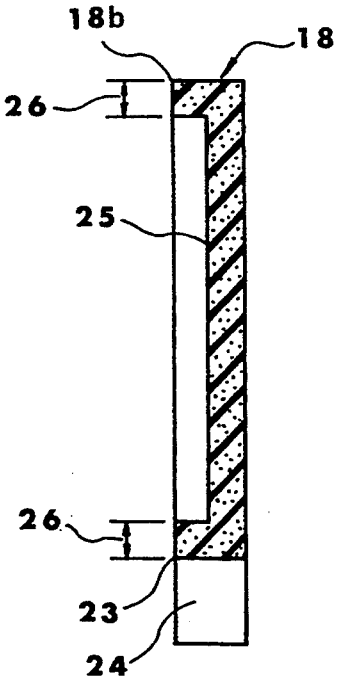
FIG. 12 is an A—A sectional view of the second fuse resistor in FIG. 11.
Figure 13:
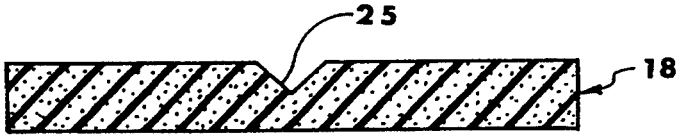
FIG. 13 is a B—B sectional view of the second fuse resistor in FIG. 11.

The A—A sectional view and the B—B sectional view of the substrate of FIG. 11 are shown in FIGS. 12 and 13. There are triangle-shaped cuttings 24 in the center top and bottom of insulating substrate 18 having the thickness of 0.635 mm in FIG. 11.

Referring to FIG. 12, a recess 25 is formed with margins 26 between the top of insulating substrate 18 and the top of cutting 24 in parallel between electrode patterns 20. If without margins, the substrate is broken down too easily, even in ordinary handling. Margins 26 are about 1 mm.

Recess 25 has a V-shape in section in FIG. 13. The depth and the width are defined as 50 Ωm to 0.2 mm, 20 μm to 60 μm, respectively.

Figure 14:
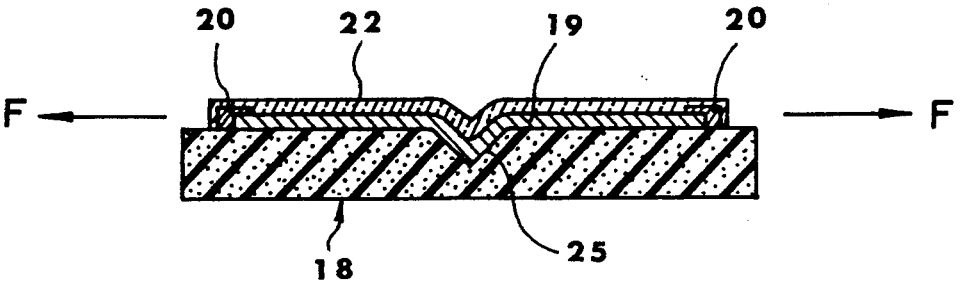
FIG. 14 is a C—C sectional view of the second fuse resistor in FIG. 11.
Figure 15:
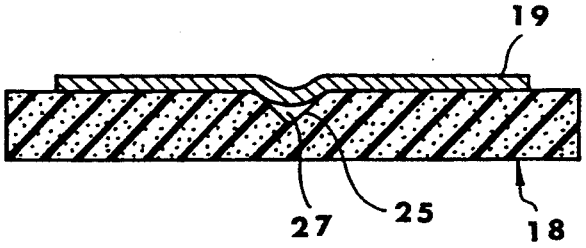
FIG. 15 is a sectional view of the second fuse resistor when a space is generated between a heat generating resistant film and a recess.

The C—C section of FIG. 10 is shown in FIG. 14. Recess 25 is filled with heat generating resistant film 19. When an overcurrrent of more than a rated value is applied to a circuit, heat generating resistant film 19 heats and expands itself, so that the force indicated by arrows F, F acts on insulating substrate 18. Insulating substrate 18 is broken along recess 25, since the high temperature region is distributed on a dashed line $\alpha$ of resistant film 12. It is also possible to break the substrate by making only recess 25, even if there is no cutting. A plurality of recesses formed in parallel can be applied so as to rupture the substrate easily.

Figure 16:
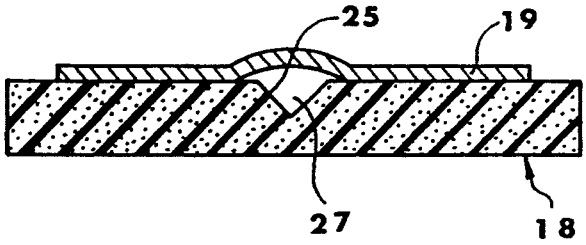
FIG. 16 is a sectional view of the second fuse resistor when the heat generating resistant film is pushed up by expansion of the space.

Heat generating resistant film 19 is made by spreading a ruthenium paste on insulating substrate 18. A space 27 formed in recess 25 in spreading pushes up resistant film 19 as shown in FIG. 16 when it expands. The upward movement makes resistant film 19 unstable. Then, it is necessary to make resistant film 19 by using the paste comprising less than 10 μm particles, so as to prevent the formation of space 27. In fact, when the angle of cutting 24 is sharper, the particles need a smaller diameter to prevent the formation of space 27, and vice versa.

Figure 17:
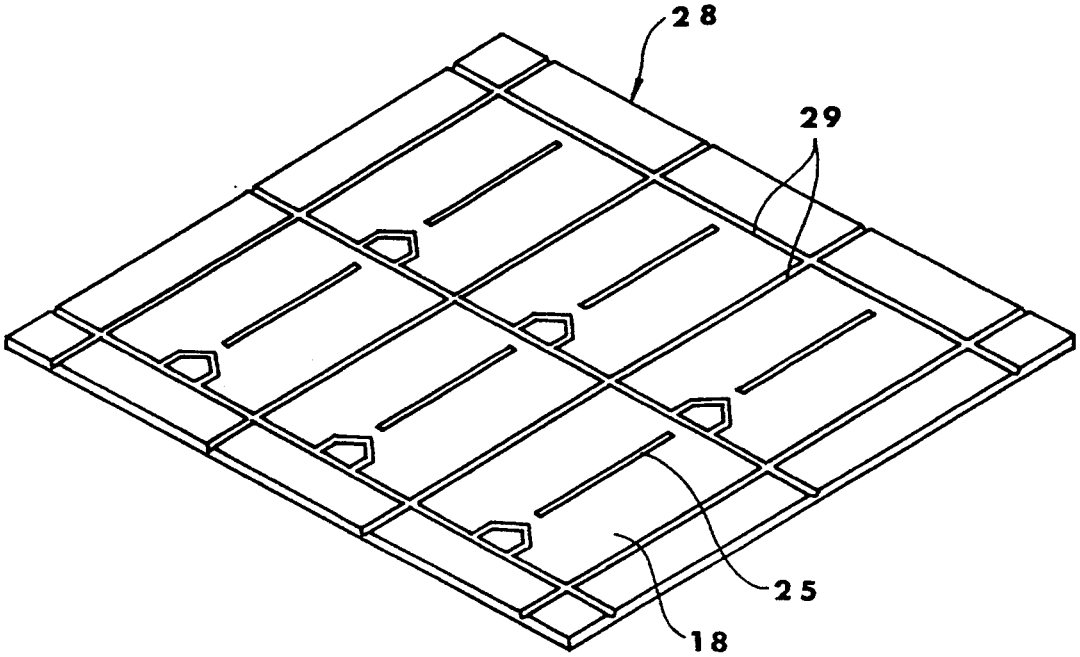
FIG. 17 is a perspective view showing the insulating substrate in mass-production.

Insulating substrate 18 can be produced through mass-production by forming recesses 29 and even recess 25 as shown in FIG. 17.

The thickness of insulating substrate 18 and the size of recess 25 are not limited to the example. Adjustment of these parameters can make the minimum shut-off current of fuse resistor 17 any desired value.

Figure 18:
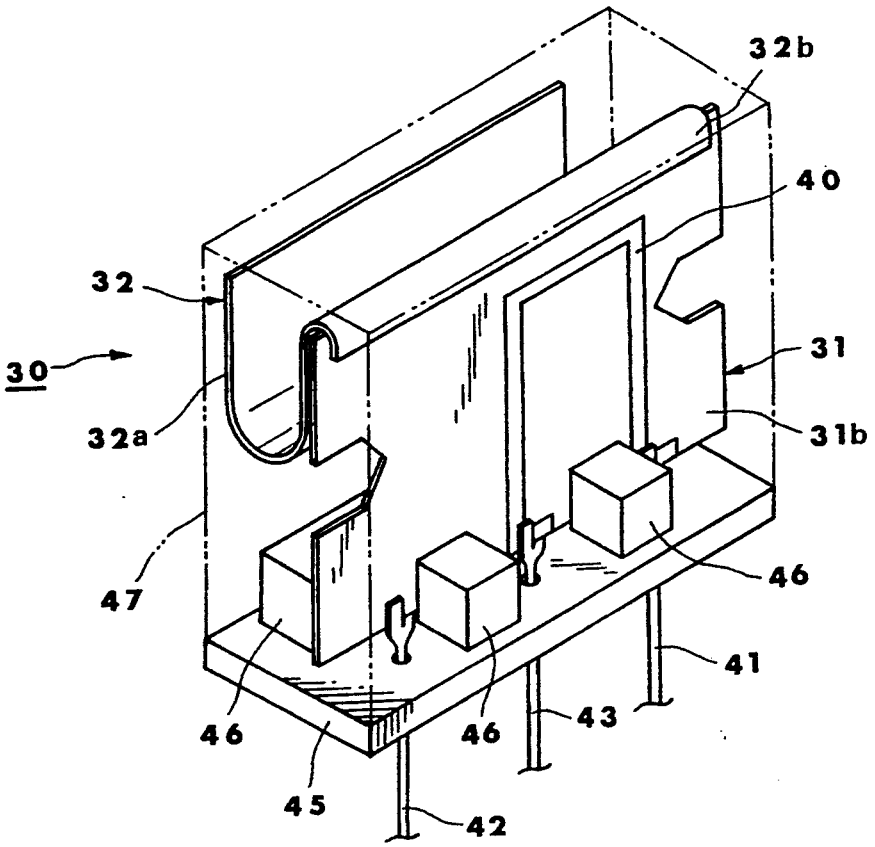
FIG. 18 is a perspective view showing a third fuse resistor according to this invention.

Referring to FIG. 18, a third fuse resistor 30 comprises an insulating substrate 31, and a first spring member 32 to urge insulating substrate 31 in a fixed direction.

Figure 20:
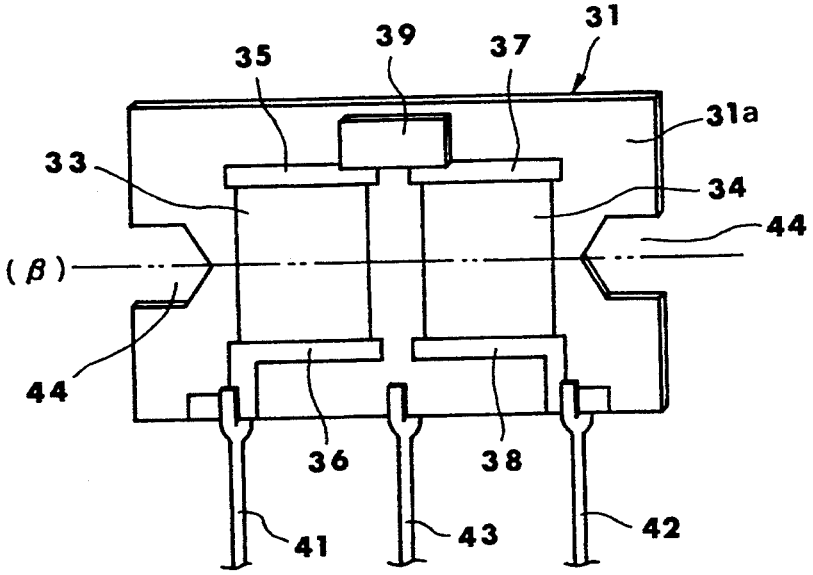
FIG. 20 is a perspective view of a first side of the insulating substrate.

There are a first heat generating resistant film 33 and a second heat generating resistant film 34 with a space therebetween on a first surface 31 a of insulating substrate 31 in FIG. 20. The resistances of first and second heat generating resistant films 33, 34 are fixed at about 6 Ω. A first electrode pattern 35 is connected to the top of first heat generating resistant film 33. A second electrode pattern 36 is connected to the bottom. A third electrode pattern 37 is connected to the top of second heat generating resistant film 34. A fourth electrode pattern 38 is connected to the bottom of second heat generating resistant film 34. A chip-type silicon surge absorber 39 fixed on a first surface 31*a* of the insulating substrate is connected electrically between first electrode pattern 35 and third electrode pattern 37.

An electric conductive pattern 40 made from a silver-palladium paste and the like is formed on a second surface 31*b* of insulating substrate 31.

Figure 21:
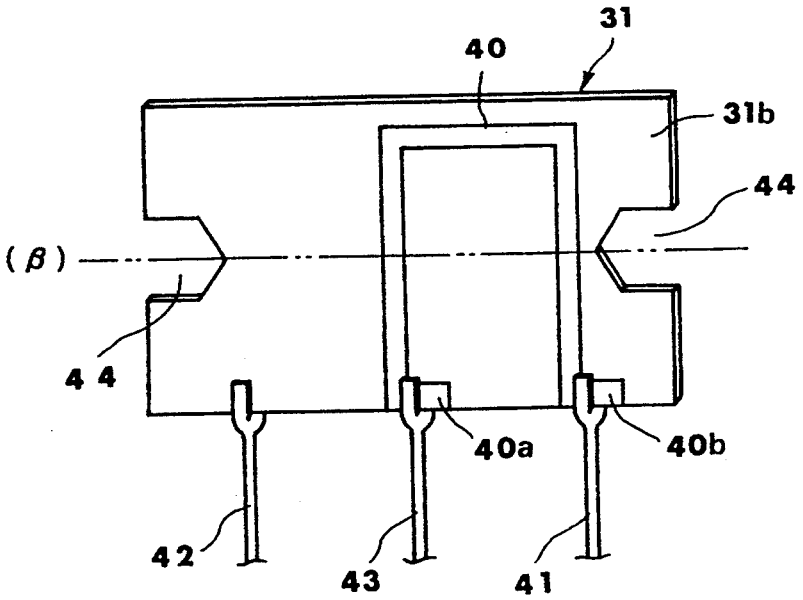
FIG. 21 is a perspective view of a second side of the insulating substrate.
Figure 22:
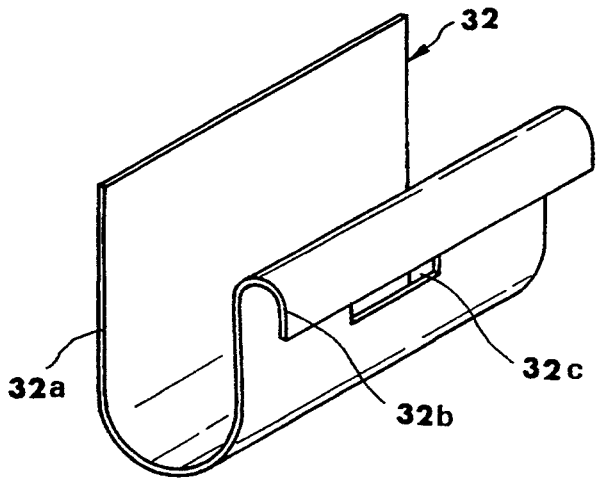
FIG. 22 is a perspective view of a first spring member of the third fuse resistor.

A first terminal 41 and a second terminal 42 are connected to second electrode pattern 36 and fourth electrode pattern 38, respectively, in FIG. 20. A third terminal 43 and first terminal 41 are connected to one end 40*a* of electric conductive pattern 40 and the other end 40*b*, respectively, in FIG. 21. Also, there are cuttings 44 at the both sides of insulating substrate 31.

First spring member 32 made from a stainless steel comprises an urging portion 32*a* having a U-shape in section and a coupling portion 32*b* having a -shape in section. There is an opening 32*c* larger than silicon surge absorber 39 located at the middle of urging portion 32*a* and coupling portion 32*b*.

Figure 19:
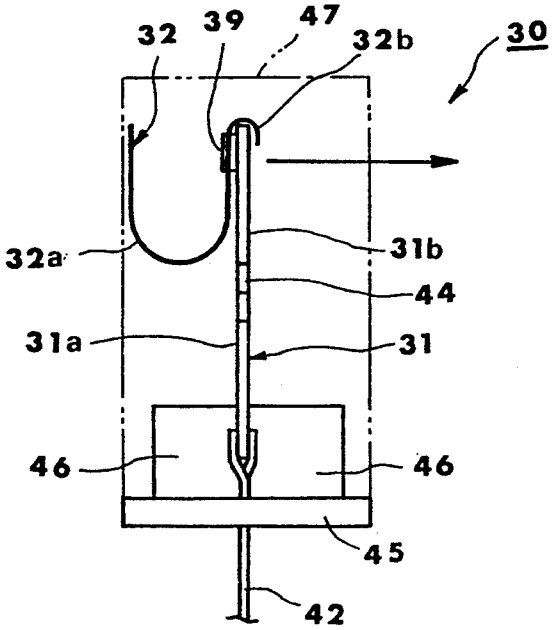
FIG. 19 is a side view of the third fuse resistor.

Insulating substrate 31 is vertically mounted sandwiched by a plurality of fixing blocks 46 on a base 45. Coupling portion 32*b* of first spring member 32 is connected to the top of insulating substrate 31 in FIG. 18. Silicon surge absorber 39 fixed on first surface 31*a* protrudes through opening 32*c* to the inside of urging portion 32*a* in FIG. 19. One outer surface of urging portion 32*a* has a contact with first surface 31*a* of insulating surface 31. The other outer surface has a contact with the inner surface of a cover 47 as shown by a two-dots dashed line. First spring member 32 is located as urging insulating substrate 31 in the direction indicated by an arrow in FIG. 19. The urging force of first spring member 32 is preferably defined as 200 g to 1 kg when the disruptive strength of insulating substrate 31 is 3.6 kg. First to third terminals 41 to 43 are led to outside through base 45.

Figure 23:
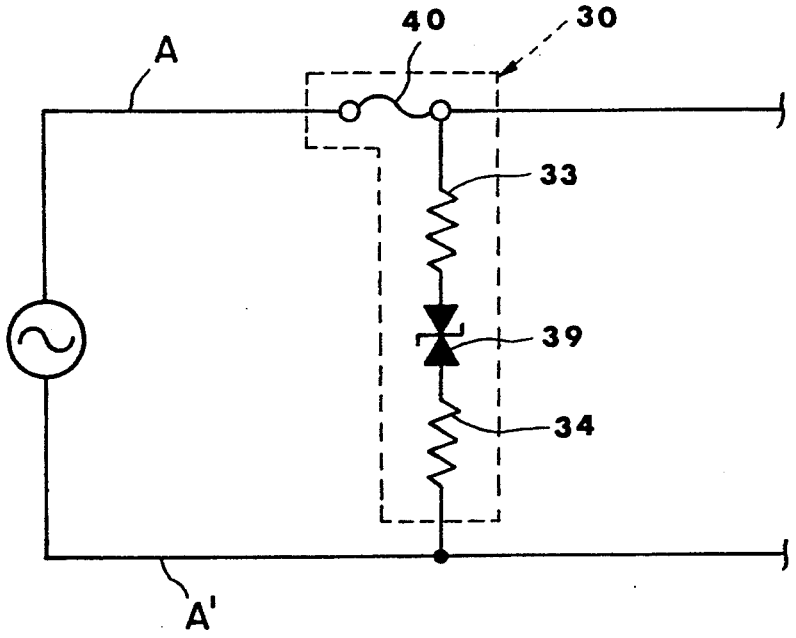
FIG. 23 is a circuit diagram showing an example in use of the third fuse resistor.

Referring to FIG. 23, first terminal 41 and third terminal 43 are connected to a power resource line A (not shown in the drawings). Second terminal 42 is connected to a line A'. Electric conductive pattern 40 may be connected in series with line A. First heat generating resistant film 33, silicon surge absorber 39, and second heat generating resistant film 34 are connected between lines A, A'.

When the an overvoltage more than a rated voltage of silicon surge absorber 39 applied a circuit by an unexpected connection and an overvoltage test, first resistant film 33 and second resistant film 34 are heated rapidly by the overcurrent from the overvoltage. First surface 31*a* of insulating substrate 31 expands. Insulating substrate 31 is broken down by the thermal stress and the urging force of first spring member 32 along a two-dots dashed line $\beta$ located between both tops of cuttings 44 in FIGS. 20 and 21. First resistant film 33 and second resistant film 34 on first surface 31*a* of insulating substrate 31 are cut down. Silicon surge absorber 39 is separated along lines A, A', and thus protected from igniting. Simultaneously, electric conductive pattern 40 on second surface 31*b* of insulating substrate 31 is cut down, so that line A opens. Overvoltage can never get into an external electronic circuit.

Figure 24:
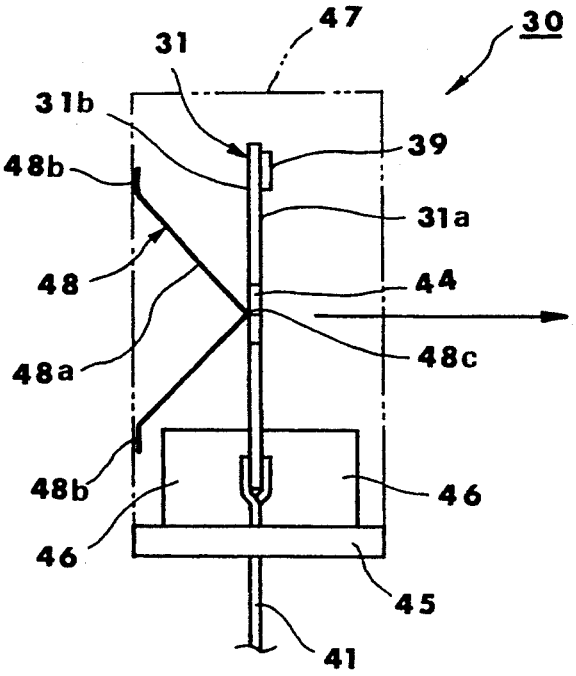
FIG. 24 is a side view showing a modification of the third fuse resistor.
Figure 25:
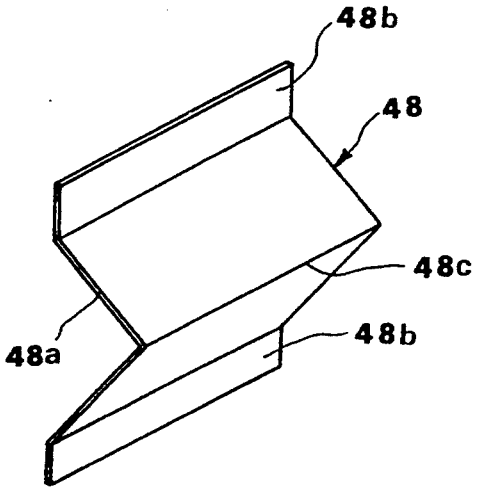
FIG. 25 is a perspective view of a second spring member of the third fuse resistor.

Second spring member 48 used in place of first spring member 32 in FIG. 24 has V-shape urging portion 48*a* in section and a support portion 48*b* led by urging portion 48*a*. In second spring member 48, bending portion 48*c* of urging portion 48*a* is in contact with a two-dots dashed line $\beta$ located between the both tops of cuttings 44. Support portion 48*b* is also in contact with the inner surface of cover 47.

When first and second heat generating resistant films 33, 34 have an overcurrent, insulating substrate 31 is broken down by the thermal stress of the heat from first and second resistant films 33, 34, and by the urging force from second spring member 48.

Figure 26:
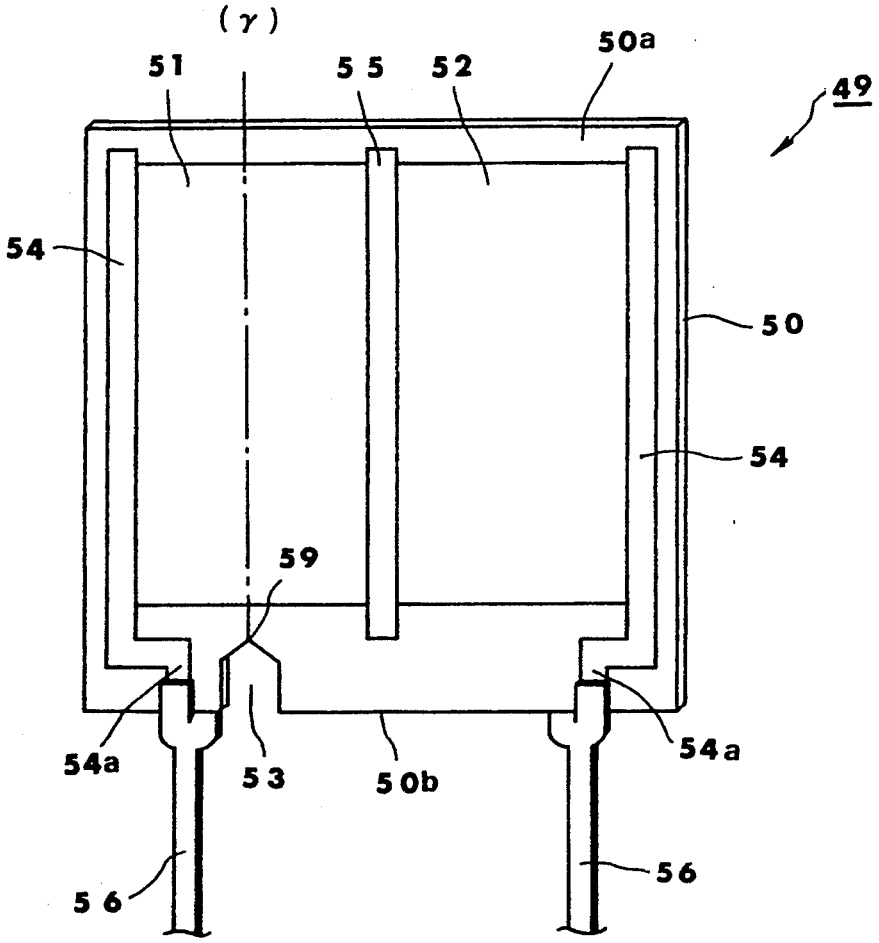
FIG. 26 is a perspective view showing a fourth fuse resistor according to this invention.

Referring to FIG. 26, fourth fuse resistor 49 comprises an insulating substrate 50, a heat generating resistant film 51 spread on a surface 50*a* of insulating substrate 50, and a resistant film 52. There is a cutting 53 at the side of resistant film 52 on the bottom 50*b* of insulating substrate 50.

Heat generating resistant films 51 and 52 in the thickness of 10 to 25 μm are made from a ruthenium paste and the like. Heat generating resistant film 51 has the resistance-temperature coefficient of 2800 to 4000 ppm/°C. Resistant film 52 has the resistance-temperature coefficient of −2800 to −4000 ppm/°C. For example, when the coefficient of heat generating resistant film 51 is 2800 ppm/°C., that of resistant film 52 may be −2800 ppm/°C. The coefficient of heat generating resistant film 51 can be adjusted by adding appropriately noble metal materials to the ruthenium paste. The coefficient of resistant film 52 can be adjusted by adding appropriately base metal materials to the ruthenium paste.

The relationship of an initial resistance $r_1$ of heat generating resistant film 51 and an initial resistance $r_2$ of resistant film 52 is expressed by the following equations:

$$r_1 = r_2,$$

and $$1\ \Omega \leqq r_1 + r_2 \leqq 50\ \Omega$$

Initial resistance is defined as the resistance at normal temperature. Initial resistances $r_1$ and $r_2$ can be adjusted by adding noble and base metal materials to a ruthenium paste. Area $S_1$ of heat generating resistant film 51 and area $S_2$ of resistant film 52 are set as $S_1 \leqq S_2$.

Electrode pattern 54 is connected to the left side of heat generating resistant film 51, and to the right side of resistant film 52. There is a coupled pattern 55 between heat generating resistant film 51 and resistant film 52. Heat generating resistant film 51 and resistant film 52 are connected to each other in series through coupled pattern 55.

Terminal coupling portions 54*a* formed at the lower side of electrode pattern 54 are connected to terminals 56.

Figure 27:
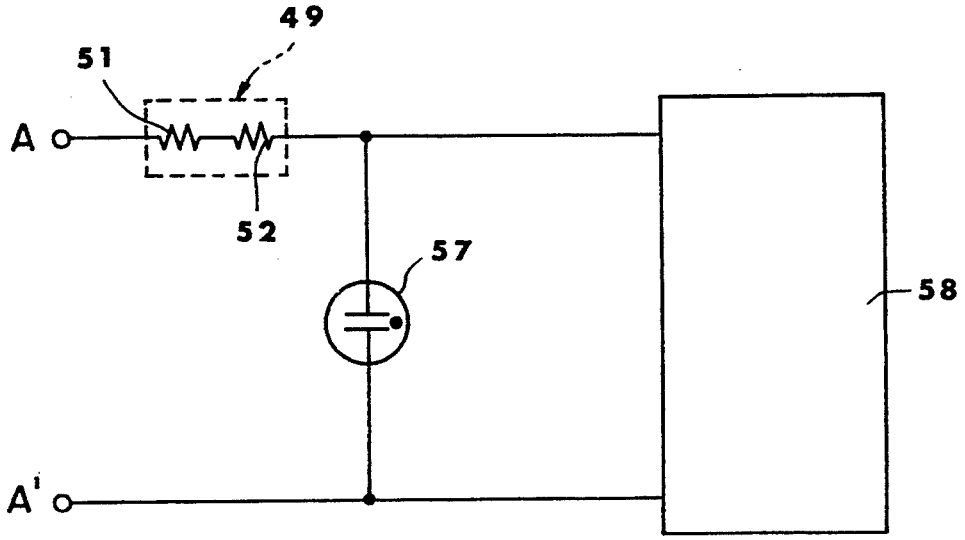
FIG. 27 is a circuit diagram showing an example in use of the fourth fuse resistor.

Referring to FIG. 27, fuse resistor 49 is connected in series to a line A through terminals 56 in the circuit such that a discharging-type surge absorbing element 57 is connected in parallel to an electronic circuit 58 between lines A, A' in a telephone line or the like.

When a surge with more than a rated voltage of surge absorbing element 57 is applied to lines A, A' for a short period, surge absorbing element 57 operates to absorb the surge. In this case, heat generating resistant film 51 does not heat so much.

When lines A, A' receive a continuous overcurrent that is more than the rated value of surge absorbing element 57, heat generating resistant film 51 heats, thus increasing its resistance. The thermal distortion causes insulating substrate 50 to be broken down along a dashed line $\gamma$ through a top 59 of cutting 53 in FIG. 26. Thus line A opens, and thus surge absorbing element 57 and electronics circuit 58 are protected against damage.

In a normal state, when the temperature outside rises, the resistance of resistant film 52 decreases corresponding to the resistance of heat generating resistant film 51, so that the combined resistance is not changed. The input impedance to electronic circuit 58 does not vary.

Figure 28:
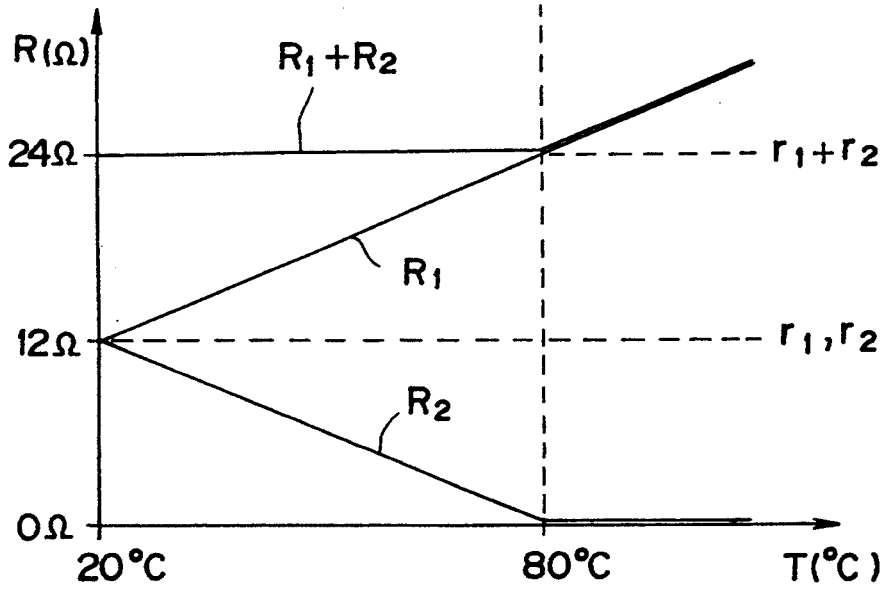
FIG. 28 shows the relationship between the resistances of the heat generating resistant film and resistant film, and the temperature.

Referring to FIG. 28, there is shown the change of resistances of heat generating resistant film 51 and resistant film 52 to the temperature. Vertical and horizontal axes are defined as resistance R (Ω) and temperature T (°C.), respectively. Initial resistances $r_1$, $r_2$ of heat generating resistant film 51 and resistant film 52 are set at 12 Ω. The resistance-temperature coefficients of heat generating resistant film 51 and resistant film 52 are set as 3700 and −3700 ppm/°C., respectively.

Between 20° and 80° C., the resistance $r_1$ of heat generating resistant film 51 is in inverse proportion to the resistance $r_2$ of resistant film 52. The combined resistance $R_1+R_2$ is not changed from 24 Ω coming from $r_1+r_2$.

At more than 80° C., the resistance $r_2$ of resistant film 52 approaches 0 Ω. The resistance $r_1$ of heat generating resistant film 51 rises rapidly. The combined resistance also rises over 24 Ω. By that time the substrate is broken.

Figure 29:
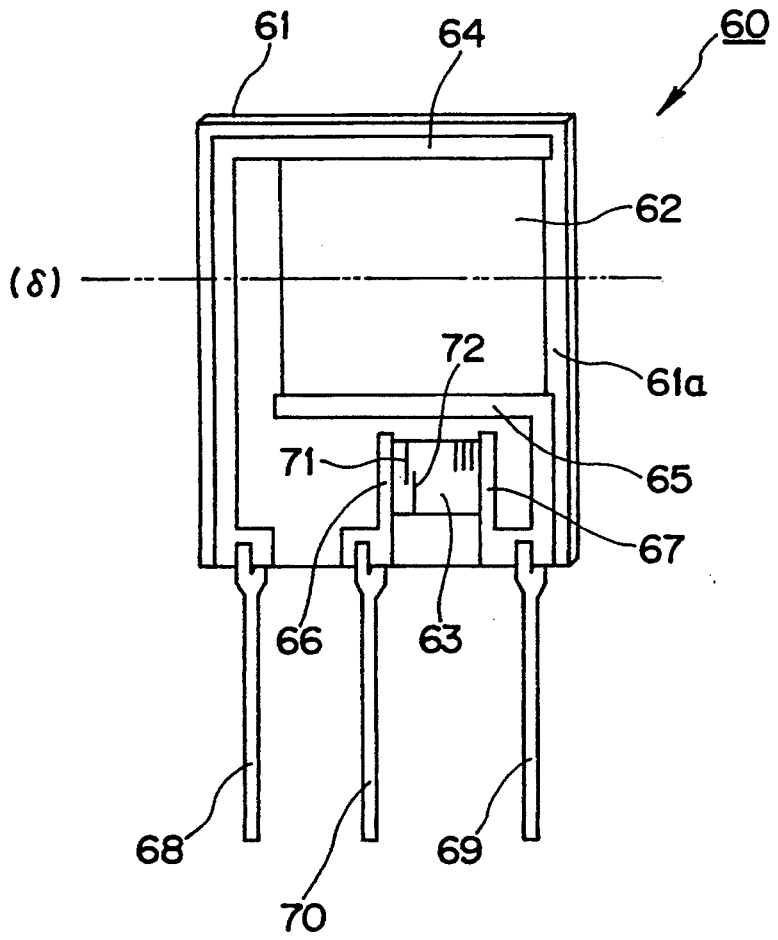
FIG. 29 is a perspective view showing a fifth fuse resistor according to this invention.

Referring to FIG. 29, a fifth fuse resistor 60 comprises an insulating substrate 61, a heat generating resistant film 62 and a metal film 63 formed on a surface 61*a* of the substrate. A first electrode pattern 64 and a second electrode pattern 65 are connected to the top and bottom of heat generating resistant film 62, respectively. A third and a fourth electrode pattern 66, 67 are connected to the left and right side of metal film 63, respectively. Fourth electrode pattern 67 is connected to second electrode pattern 65. A first terminal 68 is connected to first electrode pattern 64. A second terminal 69 is connected to second and fourth electrode pattern 65, 67. Third terminal 70 is connected to third electrode pattern 66.

Figure 30:
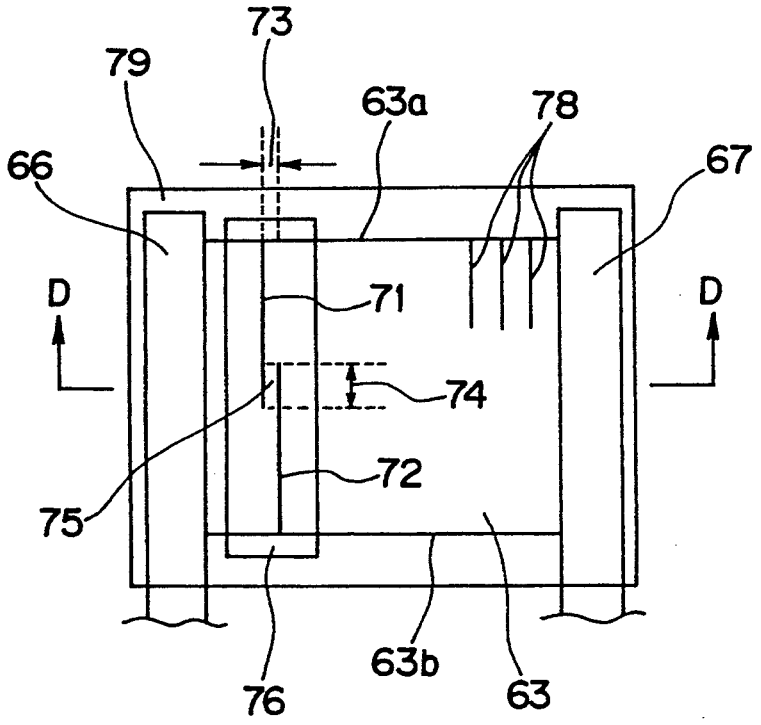
FIG. 30 is a partially enlarged view showing a metal film of the fifth fuse resistor according to this invention.

Metal film 63 spread on insulating substrate 61 is a compound of Fe, Ni, P and the like, or Fe, Cu, P and the like, which has the thickness of 1 to 5 μm. A first cut line 71 is formed from the top 63*a* of metal film 63 over the center in FIG. 30. A second cut line 72 is formed from the bottom 63*b* of metal film 63 over the center. There is a gap 73 of 5 μm to 1 mm between first and second cut lines 72, 73. First and second cut lines have an overlapped portion 74. There is a space 75 between first cut line 71 and second cut line 72 through to pass a current.

Figure 31:
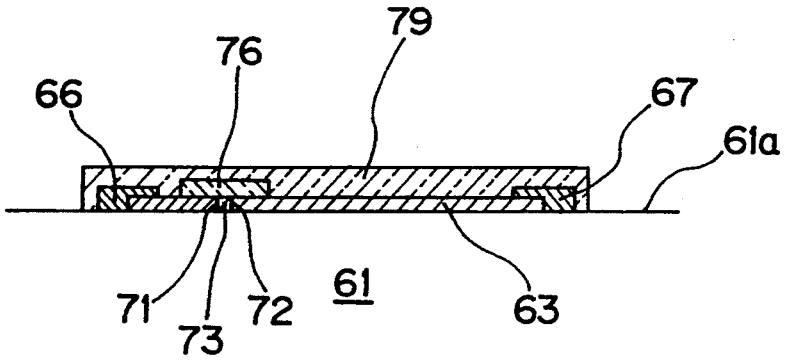
FIG. 31 is a D—D sectional view of the metal film in FIG. 30.

Referring to FIG. 31, which is a sectional view at a line D—D, thermoplastic film 76 that coats first and second cut lines 71,72 on the surface of metal film 63 has a thickness of about 10 μm to 100 μm. Metal film 63 has three more cuttings 78 for adjusting the resistance of metal film 63, for example, each approximately 20 Ω or less. The total of the resistance of heat generating resistant film 62 and metal film 63 is set at less than 50 Ω. A resin layer 79 is produced on the surface of metal film 63, thermoplastic film 76, third electrode pattern 66 and fourth electrode pattern 67 to protect them from a surface discharge.

Figure 32:
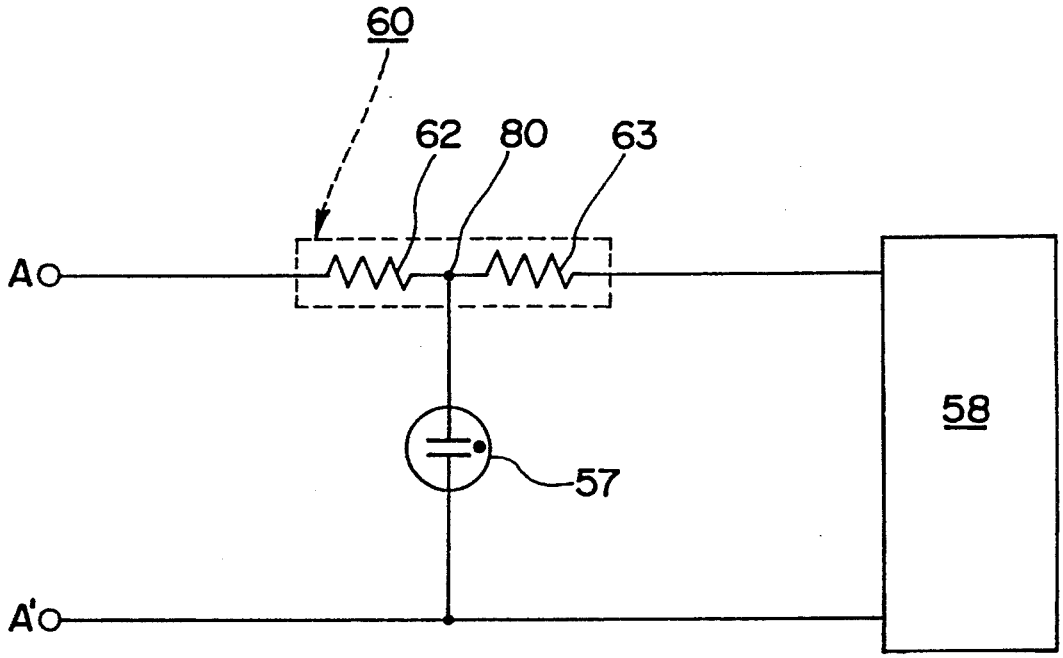
FIG. 32 is a circuit diagram showing an example in use of the fifth fuse resistor.

First terminal 68 and third terminal 70 are connected to a line A led to an electronic circuit 58 in FIG. 32. Second terminal 69 is connected to one end of discharging-type surge absorbing element 57, whose other end is connected to a line A'.

When a surge that is more than a rated voltage of surge absorbing element 57 is applied to lines A, A', surge absorbing element 57 operates to absorb the surge.

When lines A, A' receive a continuous overcurrent that is more than the rated value of surge absorbing element 57, heat generating resistant film 62 heats. The thermal distortion causes insulating substrate 61 to break along a two-dots dashed line 6 in FIG. 29. Line A opens, and surge absorbing element 57 and electronics circuit 58 are protected from damage.

When lines A, A' receive a continuous current that is less than the rated value of surge absorbing element 57, metal film 63 heats and melts from the current. Thermoplastic film 76 melts and gets into metal film 63 at a space 75 so as to cut the current path between the tops of first and second cut lines 71, 72 on metal film 63. Thus surge absorbing element and electronics circuit 58 are protected from damage.

In the above, the shut-off current is adjusted to be 250 to 500 mA. When gap 73 between first cut line 71 and second cut line 72 becomes large, the shut-off current increases, and vice versa.

Fuse resistor 60 can be satisfied with the four modes of TEST M-1 to M-4 in UL1459, which is well-known as a safety confirmation test of a telephone line. It tests the protective device to protect the load circuit against overvoltage in the following conditions.

TABLE 2

| | VOLTAGE ON OPENING (V) | CURRENT ON SHORTING (A) | OPERATE TIME (SEC) |
|---|---|---|---|
| TEST M-1 | AC 600 | 40 | 1.5 |
| TEST M-2 | AC 600 | 7 | 5 |
| TEST M-3 | AC 600 | 2.2 | 30 (MIN) |
| TEST M-4 | * | 2.2 | 30 (MIN) |

In TEST M-1 to M-3, discharging-type surge absorbing element 57 absorbs the overvoltage, since the operating range of the element is 270 V to 500 V, so that the circuit is protected. Originally, the element is constructed so that insulating substrate 61 may be broken by heat generating resistant film 62 before the overcurrent of the range of 2.2 to 40 A is turned on for the predetermined period, 1.5 SEC to 30 MIN.

In TEST M-4, however, discharging-type surge absorbing element 57 does not operate because of the voltages of AC 190 V to AC 353 V are lower than the rated voltage of the element. The overcurrent may get into metal film 63 and electronics circuit 58 through heat generating resistant film 62 and a coupling point 80. Since the overcurrent is reduced to less than 2.2 A by the impedance in electronic circuit 58, the substrate is not broken down. In the prior art, a fuse with a rated current of less than 2.2 A is additionally connected to the circuit. Fuse resistor 60 can be applied for TEST M-4 without an additional fuse because metal film 63 is insulated.

Figure 33:
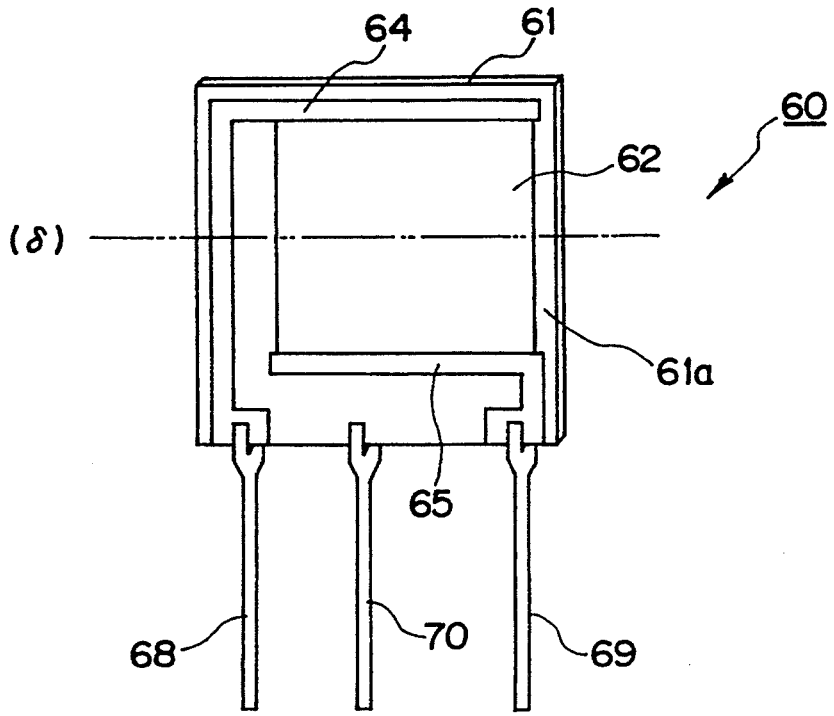
FIG. 33 is a perspective view showing a modification of the fifth fuse resistor.
Figure 34:
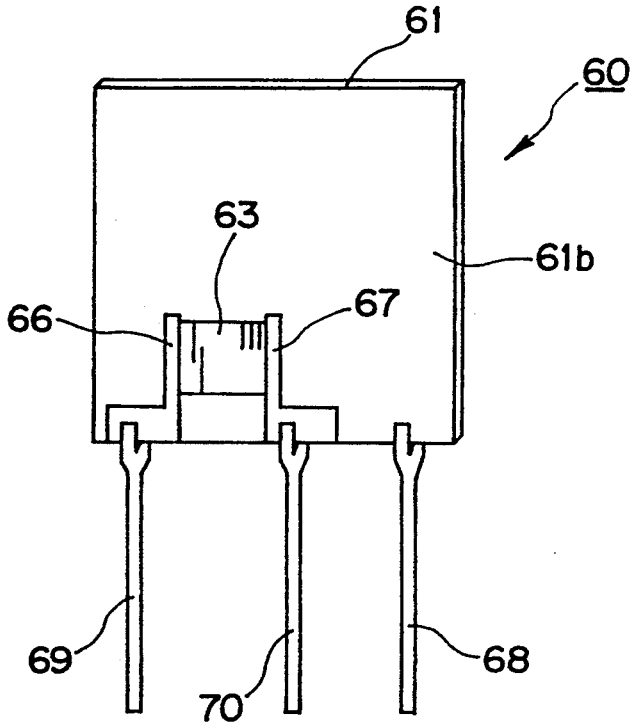
FIG. 34 is a perspective view showing another modification of the fifth fuse resistor.

Referring to FIGS. 33 and 34, there is a modification of a fifth fuse resistor 60 comprising insulating substrate 61, heat generating resistant film 62 formed on surface 61*a* of the substrate, and metal film 63 formed on surface 61*b* of the substrate. Second terminal 69 is connected to first and third electrode patterns 65, 66. Fourth electrode pattern 67 is connected to third terminal 70. In this case, since surface 61*b* of the substrate is used effectively, it is possible to make fifth fuse resistor 60 very compact.

Figure 35:
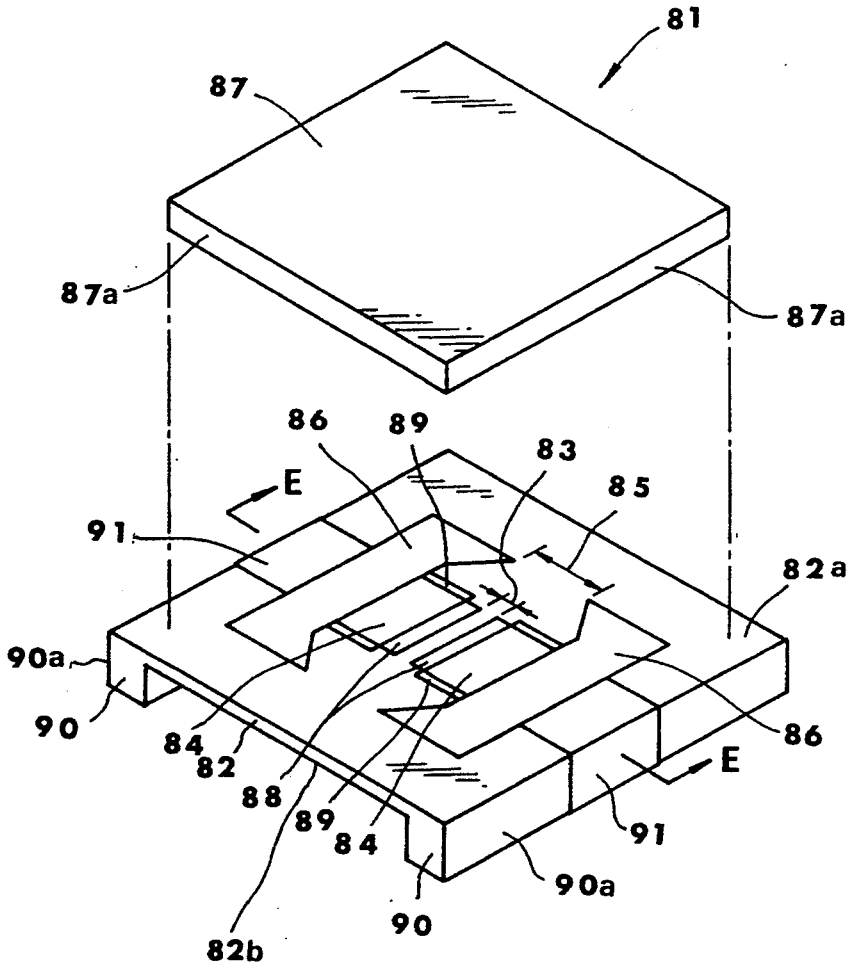
FIG. 35 is a perspective view showing a first discharging-type surge absorbing element with a security mechanism according to this invention.

Referring to FIG. 35, a first discharging-type surge absorbing element with security mechanism 81 comprises an insulating substrate 82 with a thickness of 0.4 to 1.0 mm, a pair of heat generating resistant films 84, 84 formed with a tiny space 83 of 10 to 100 μm on a surface 82*a* of insulating substrate 82, a pair of discharging electrode films 86 formed with a space 85 of 0.2 to 10 mm, and a cover 87.

Heat generating resistant film 84 produced from a ruthenium paste and the like has a thickness of 10 to 25 μm. It is possible to change the resistance-temperature coefficient and the initial resistance of heat generating resistant film 84 by appropriately adding noble metal materials to the paste. In this case, the coefficient and the resistance are set at 2500 to 4000 ppm/°C. and 0.1 to 5 Ω, respectively.

Discharging electrode film 86 connected to heat generating resistant film 84 is produced from a conductive material with sputtering resistance such as W, Mo, $LaB_6$, $MoSi_2$, and $TiO_2$, and a metal thin film of 42-6 compound metal, 42 compound metal, or the like. It is also possible to produce discharging electrode film 86 so that there is disposed on the metal thin film a plasma spray coating of the conductive material, and an emitter material such as BaO, MgO, CaO or the like.

A conductive coating film 88 with sputtering resistance such as W, Mo, $LAB_6$, $MoSi_2$, $TiO_2$, or the like is spread on heat generating resistant film 84 by plasma spray coating. The coating film 88 prevents a deterioration of tiny discharging space 83 from the sputter of heat generating resistant film 84. The surface of heat generating resistant film 84 is covered with insulating film 89 made from amorphous glass and the like to protect from surface discharge.

Foot portions 90 are formed integrally at both sides of surface **82*b* of insulating substrate 82**.

A pair of thin film terminals 91 connected to discharging electrode film 86 is formed from surface **82*a* of insulating substrate 82 to the side 90*a* of foot portions 90**, and constructed so that Ni and a solder are gilded on the surface of a silver-palladium paste. Also, the solder can be gilded on the surface of a Ni paste.

Figure 36:
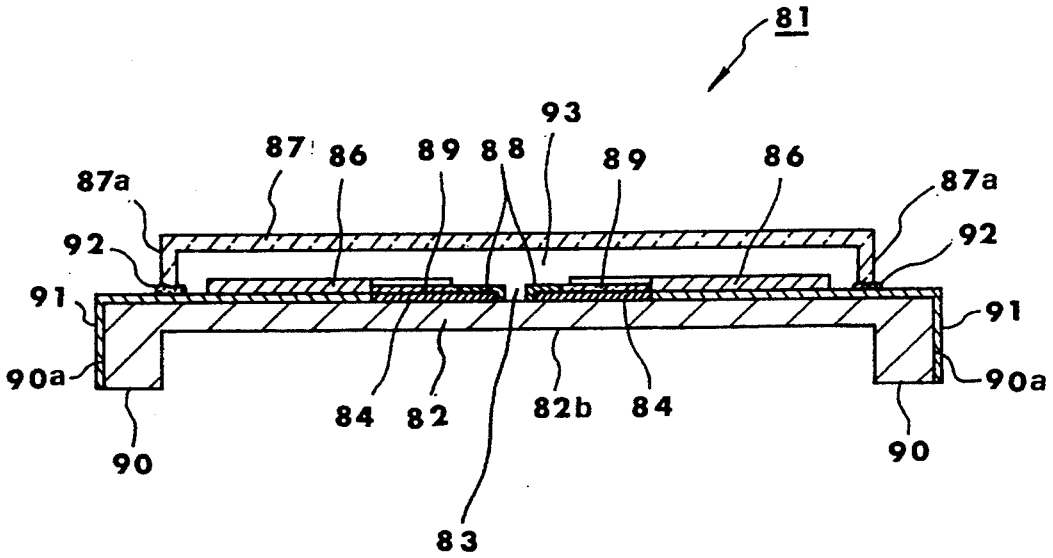
FIG. 36 is an E—E sectional view of this invention in FIG. 35.

Referring to FIG. 36, cover 87 produced from an insulating material such as glass, ceramics, and the like has a thickness of 3 to 10 mm. Side **87*a* of cover 87 and surface 82*a* of insulating substrate 82 are fixed by an adherent material 92 made from a low melting point glass and the like to produce a discharging space 93 therebetween. Discharging space 93** is filled with a rare gas such as He, Ne, Ar, Xe or the like, or their combination.

In the case of discharging-type surge absorbing element with security mechanism 81 on a print substrate in an electronics device, when a surge is applied to a circuit through thin film terminal 91, the potential difference of heat generating resistant films 84 causes a surface discharge at tiny discharging space 83, thus producing a glow discharge by a priming effect. The increase of the surge current causes the glow discharge to be transformed into an arc discharge at discharging space 85, so that the surge is absorbed.

When the overvoltage continues to be applied to the circuit by an unexpected connection or an overvoltage test, the overcurrent by discharge in tiny space 83 and space 85 causes heat generating resistant film 84 to heat, and breaks it down by thermal distortion. As a result, air gets into the space full of the discharging gas. The arc discharge disappears, opening the circuit.

Since the element is kept clear of the substrate by foot portions 90, 90, it is easy to break down the substrate.

Figure 37:
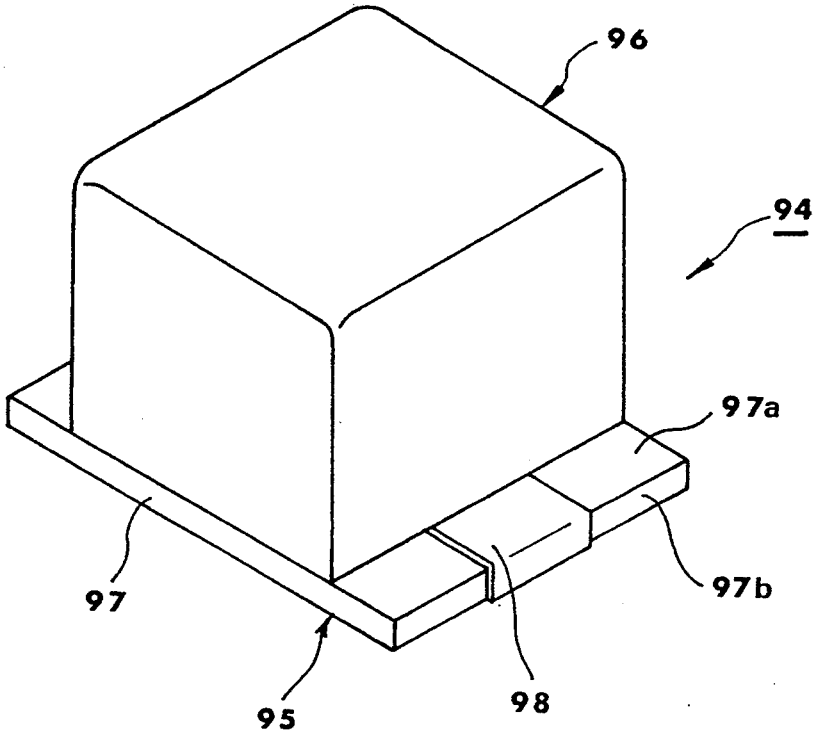
FIG. 37 is a perspective view showing a second discharging-type surge absorbing element with a security mechanism according to this invention.
Figure 38:
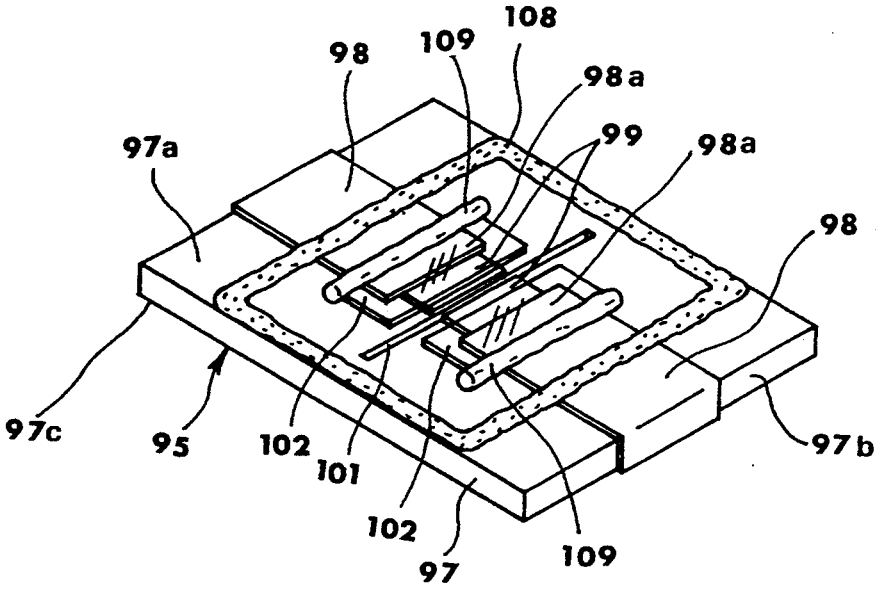
FIG. 38 is a perspective view showing a substrate body of the second discharging-type surge absorbing element with a security mechanism.
Figure 39:
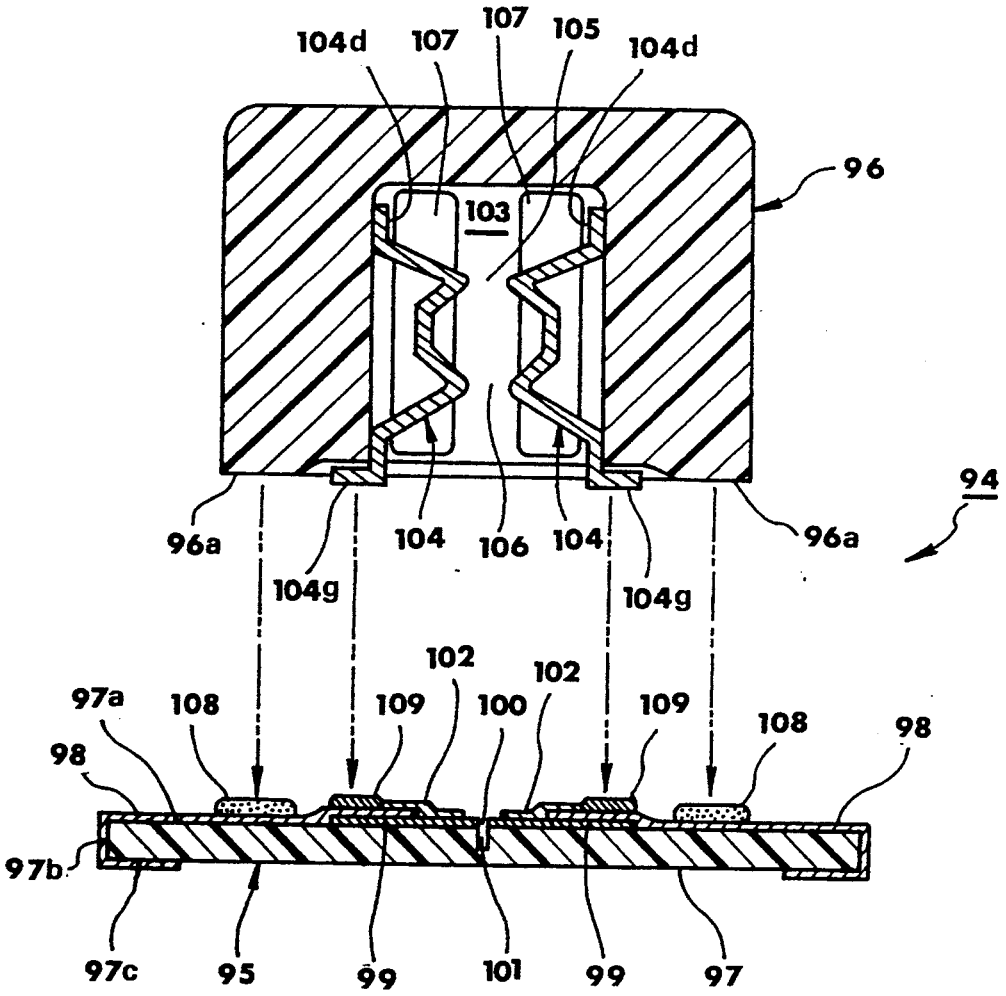
FIG. 39 is a sectional view of the second discharging-type surge absorbing element with a security mechanism.

Referring to FIGS. 37 to 39, a second discharging-type surge absorbing element 94 comprises a substrate 95, and a cap 96 mounted on substrate 95.

Substrate 95 comprises an insulating substrate 97, a pair of thin film terminals 98, and heat generating resistant film 99 connected to top **98*a* of thin film terminals 98. There is a tiny space 100 of 10 to 100 μm between heat generating resistant films 99. Recess 101 is formed on the substrate. A crossover glass is formed at the connection of thin film terminals 98 and heat generating resistant film 99**, whose resistance is set at less than 6 Ω.

Figure 40:
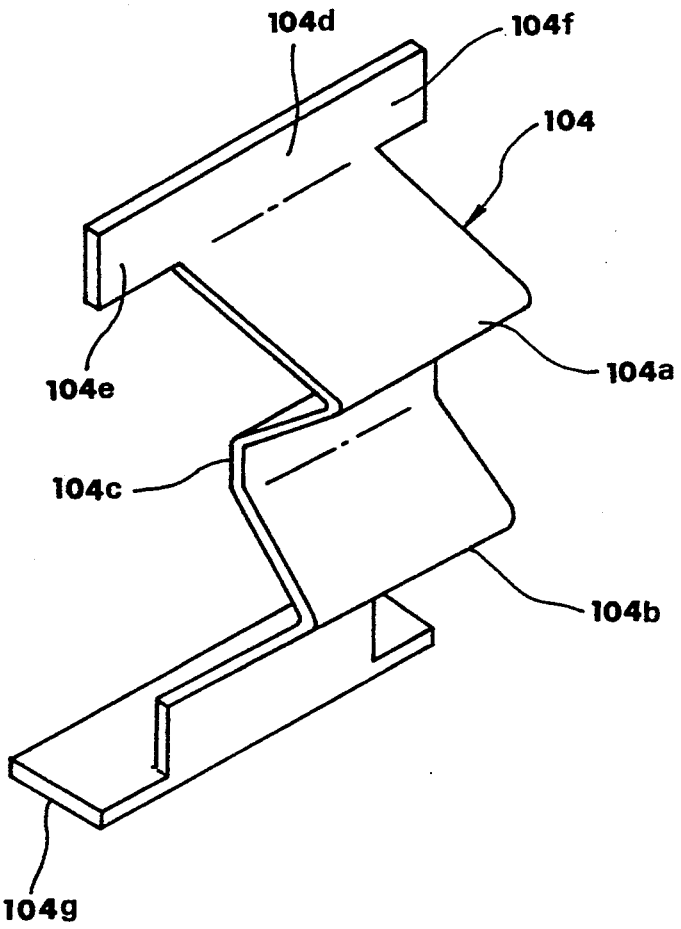
FIG. 40 is a perspective view showing a discharging electrode of the second discharging-type surge absorbing element with a security mechanism.

Cap 96 produced from such ceramics as alumina, forsterite and the like has a space 103 with a pair of discharging electrodes 104 inside. Discharging electrodes 104, constructed from material with a discharge property such as Ni, 426 compound metal or the like, has a M-shape in section in FIG. 40. Such emitter materials as BaO, $LAB_6$, $MoSi_2$, and $TiO_2$ are spread on the surface of discharging electrode 104. A first set of discharging spaces 105 are formed between first tops **104*a*. A second set of discharging spaces 106 are formed between second tops 104*b***.

Figure 41:
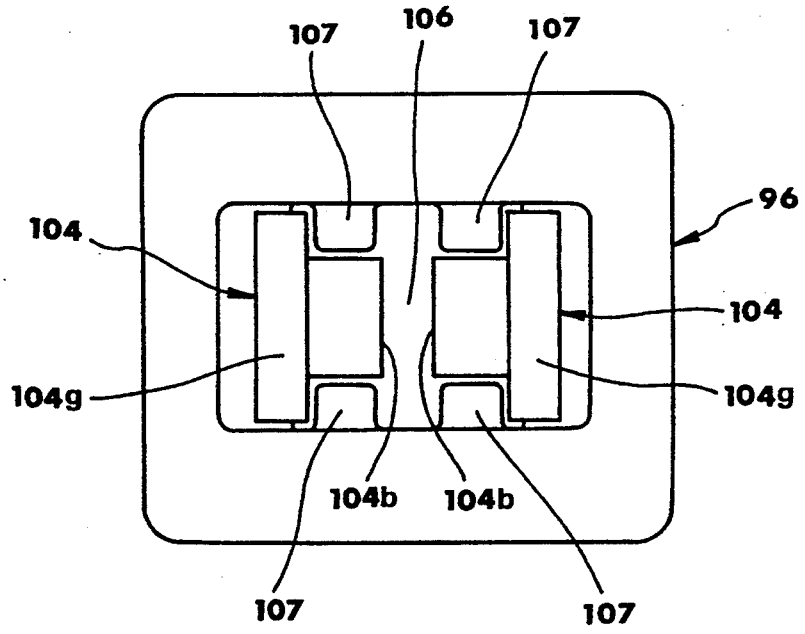
FIG. 41 is a plan view from the bottom of a cap body in the second discharging-type surge absorbing element with a security mechanism.

Discharging electrodes 104 are supported by four protrusions 107 formed at inner sides of cap 96 in FIG. 41. First tops **104*a*, V-shape portion 104*c*, second top 104*b* of each discharging electrode are sandwiched by protrusions 107 so as to fix discharging electrodes 104, 104. A bottom 104*g* of each discharging electrode protrudes a little (0.05 to 0.2 mm) below a bottom plane 96*a* of cap 96 in FIG. 39**.

An adherent material 108 produced from frit or and the like is spread on surface **97*a* of the substrate to fit bottom plane 96*a* of cap 96. Coupling material 109 such as a silver paste and the like is spread on thin film terminal 98 to fit bottom 104*g* of each discharging electrode 104. A space 103 of cap 96 is filled with discharging gas. After cap 96 is mounted on the substrate appropriately, the whole device is heated. Adherent material 108 melts. Cap 96 is attached to insulating substrate 97, so that space 103 of cap 96 becomes a discharging space. Discharging electrode 104 is connected electrically to thin film terminal 98** through the space.

The protrusion of bottom **104*g* makes it easy to fix cap 96 on insulating substrate 95** because there is more pressure at the connection between the protrusion and the substrate than elsewhere. It is possible to decrease contact resistance.

Second discharging-type surge absorbing element with security mechanism 94 can be used on a circuit of an electronic device by soldering or the like.

When a surge gets into circuit lines, tiny discharging space 100 between heat generating resistant films 99 has a surface discharge that leads to a glow discharge. The glow discharge makes discharges in second discharging space 106 and first discharging space 105. An arc discharge occurs to absorb the surge. When the lines receive a continuous overcurrent more than a rated value, heat generating resistant films 99, 99 heat. The thermal distortion causes insulating substrate 61 to be broken along recess 101. Then, the discharges of first and second discharging spaces 105, 106 disappears, thereby preventing surge absorbing element 94 from igniting.

Figure 42:
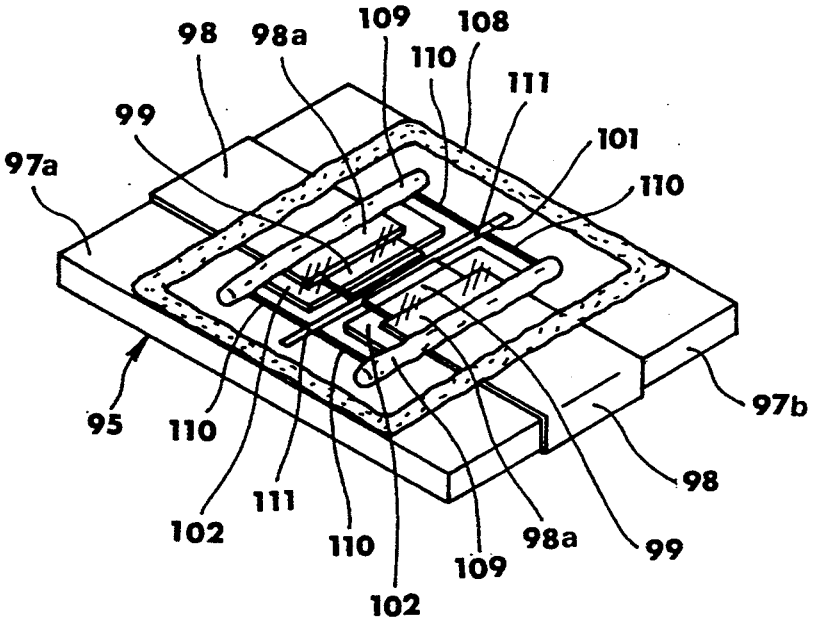
FIG. 42 is a perspective view showing a substrate body of a modification of the second discharging-type surge absorbing element with a security mechanism.
Figure 43:
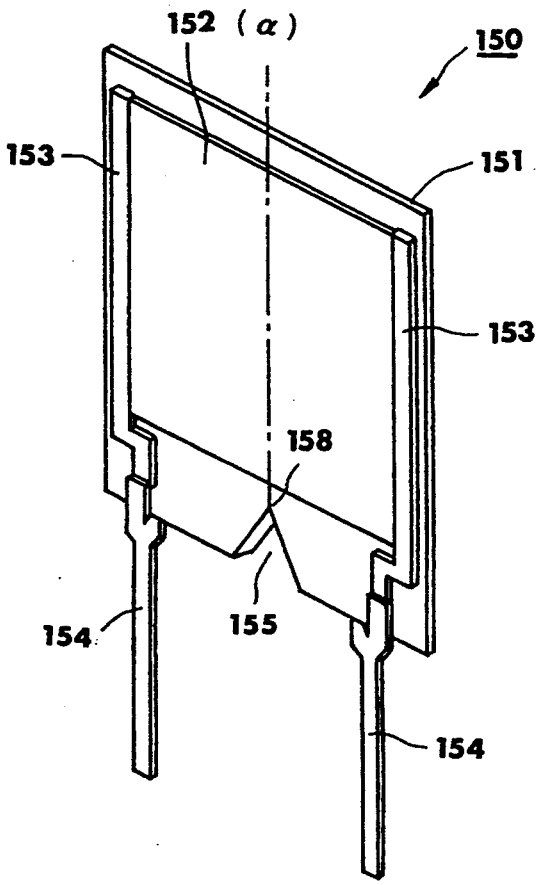
Fig. 43 PRIOR ART
FIG. 43 is a perspective view showing a fuse resistor in the prior art.
Figure 44:
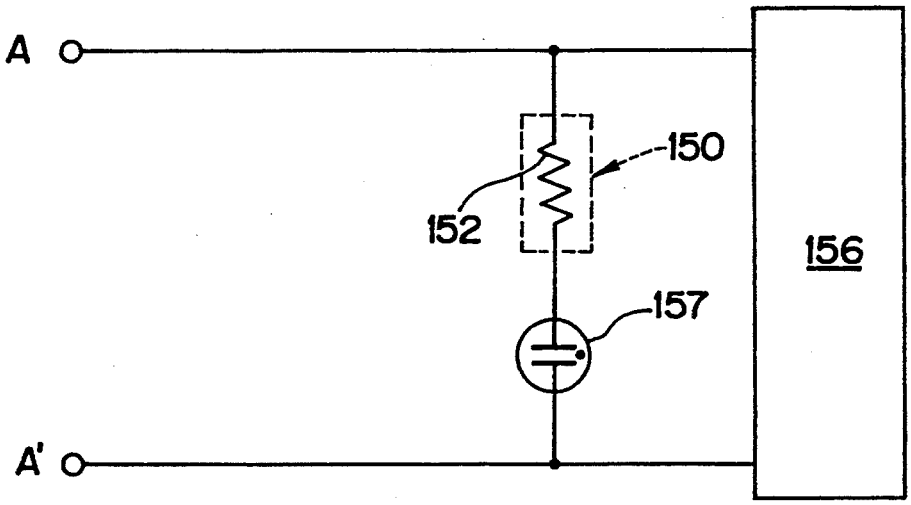
Fig. 44 PRIOR ART
FIG. 44 is a circuit diagram showing an example of the prior art in use.
Figure 45:
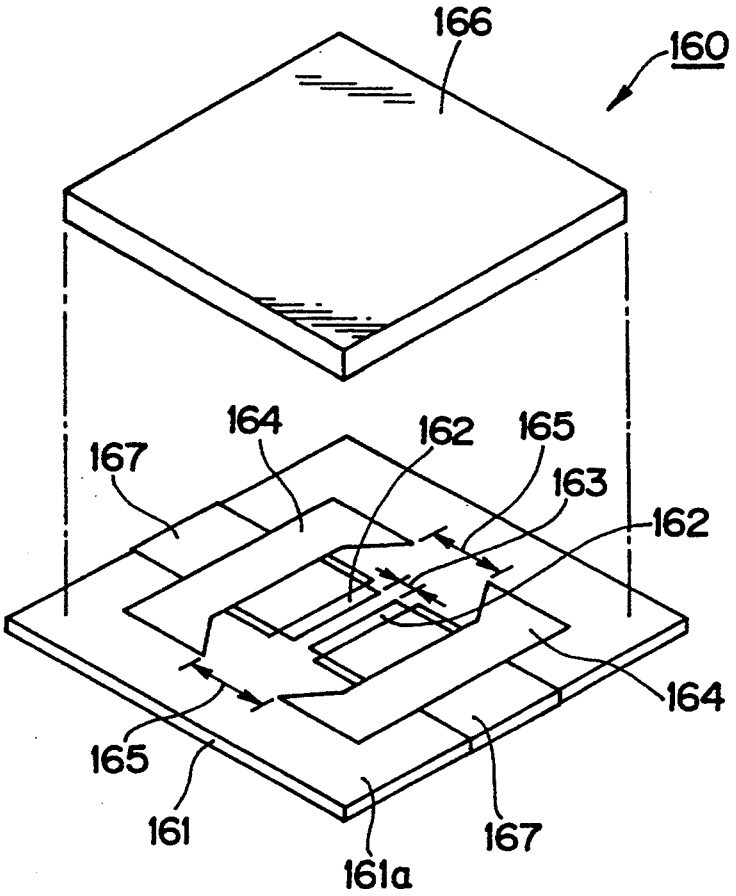
Fig. 45 PRIOR ART
FIG. 45 is a perspective view showing a discharging-type surge absorbing element in the prior art.

Referring to FIG. 42, it is also possible to construct the element such that four supplemental discharging electrodes 110 made from electrical conductive material are disposed on surface **97*a* of the insulating substrate. Supplemental discharging electrodes 110 are arranged in parallel to both sides of heat generating resistant film 99. In electrodes 110, one end is connected to thin film terminal 98 through coupling portion 109, and the other end goes to recess 101. There are disposed supplemental discharging spaces 111 between two of electrodes 110. When a surge enters the element, a surface discharge occurs at supplemental discharge space 111. The surface discharge is led to heat generating resistant films 99, so that another surface discharge takes place at tiny discharging space 100. The priming effect from these surface discharges can make an arc discharge at first and second discharge spaces 105, 106**.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A fuse resistor comprising:

an insulating substrate;

a heat-generating resistant film being on said insulating substrate;

said heat-generating resistant film being connected to an external circuit;

said heat-generating resistant film being heated when an overcurrent of more than a predetermined value is applied to said circuit, whereby said insulating substrate is fractured by heat from said heat-generating resistant film when said overcurrent exceeds said predetermined value, thereby breaking said circuit;

said heat-generating resistant film having a first resistance-temperature coefficient effective for fracturing said insulating substrate;

a resistant film having a second resistance-temperature coefficient being connected in series to said heat-generating resistant film; and said second insulating substrate resistance-temperature coefficient being negative.

2. A fuse resistor according to claim 1, wherein said first resistance-temperature coefficient is in the range from 2800 to 4000 ppm/°C. and said second resistance-temperature coefficient is in the range from −2800 to −4000 ppm/°C.

3. A fuse resistor comprising:

an insulating substrate having a first and a second surface;

a heat-generating resistant film being formed on said insulating substrate;

a metal film being formed on said insulating substrate;

a first circuit connected to said metal film;

a thermoplastic film being formed on said metal film;

said heat-generating resistant film being connected to a second circuit;

said heat-generating resistant film being heated when a first current of more than a predetermined value is applied to said second circuit, whereby said insulating substrate is fractured by heat from said heat-generating resistant film when said first current exceeds said predetermined value, thereby breaking said second circuit;

at least a portion of said metal film being melted when a second current of less than said predetermined value is applied to said second circuit;

said thermoplastic film being melted after said at least a portion melts, whereby said thermoplastic film fills a gap in said metal film; and said first circuit being opened by said gap.

4. A fuse resistor according to claim 3, wherein both said heat-generating resistant film and said metal film are both formed on a one of said first and said second surface.

5. A fuse resistor according to claim 3, wherein said heat-generating resistant film is formed on said first surface and said metal film is formed on said second surface.

6. A discharging-type surge absorbing element with a security mechanism, comprising:

an insulating substrate;

a pair of heat-generating resistant films being formed on said insulating substrate;

a pair of discharging surge absorbing electrode films being formed on said insulating substrate;

a cover;

said pair of heat-generating resistant films having a discharging space therebetween;

said pair of discharging surge absorbing electrode films being connected to an external circuit;

said pair of discharging surge absorbing electrode films being further connected to said pair of heat-generating resistant films;

said cover covering said insulating substrate to form a space filled with a discharge gas;

said pair of heat-generating resistant films being heated when a first overcurrent of more than a predetermined value is applied to said external circuit, whereby said insulating substrate is fractured by heat from said heat-generating resistant film when said overcurrent exceeds said predetermined value, thereby breaking said circuit; and said pair of heat-generating resistant films having physical properties effective for fracturing said insulating substrate.

7. A discharging-type surge absorbing element according to claim 6, wherein said resistance-temperature coefficient is in the range from 2500 to 4000 ppm/°C.

8. A discharging-type surge absorbing element according to claim 6, wherein an initial resistance of said heat-generating resistant films is in the range from 0.1 to 5 Ω.

9. A discharging-type surge absorbing element according to claim 6, wherein a pair of foot portions are formed, one at each side of said insulating substrate.

10. A discharging-type surge absorbing element with a security mechanism comprising:

an insulating substrate;

a pair of terminals formed on said insulating substrate;

a pair of heat-generating resistant films each connected to a one of said pair of terminals;

a cap on said insulating substrate;

a pair of discharging surge absorbing electrodes in said cap and connected to said pair of terminals;

said pair of heat generating resistant films having a tiny discharging space therebetween;

said cap covering said insulating substrate to produce a space;

said space being filled with a discharge gas;

said pair of discharging electrodes having a discharging space therebetween; and said insulating substrate having a recess corresponding to said tiny discharging space.

11. A discharging-type surge absorbing element according to claim 10, wherein:

a plurality of supplemental discharging electrode lines are formed on said insulating substrate;

a first end of each of said plurality is connected to a one of said pair of terminals; and a supplemental discharging space is formed between second ends of each pair of said plurality.

* * * * *